US006055404A

United States Patent [19]

Yamazaki et al.

[11] Patent Number: 6,055,404

[45] Date of Patent: Apr. 25, 2000

[54] CLEANING DEVICE FOR ELECTROPHOTOGRAPHIC APPARATUS, ELECTROPHOTOGRAPHIC APPARATUS, METHOD FOR CLEANING LIGHT RECEIVING MEMBER OF ELECTROPHOTOGRAPHIC APPARATUS, AND ELECTROPHOTOGRAPHIC PROCESS COMPRISING THE CLEANING METHOD

[75] Inventors: Koji Yamazaki, Odawara; Toshiyuki Ehara; Yuji Nakayama, both of Yokohama; Hironori Ohwaki, Mishima, all of Japan

[73] Assignee: Canon Kabushiki Kaisha, Tokyo, Japan

[21] Appl. No.: 09/309,765

[22] Filed: May 11, 1999

[30] Foreign Application Priority Data

May 13, 1998 [JP] Japan ..... 10-130449
May 14, 1998 [JP] Japan ..... 10-132246

[51] Int. Cl.[7] ..... G03G 21/00

[52] U.S. Cl. ..... 399/350; 15/256.51; 430/125

[58] Field of Search ..... 430/125; 399/347, 399/350, 349; 15/256.51, 256.52

[56] References Cited

U.S. PATENT DOCUMENTS

| | | | |
|---|---|---|---|
| 4,974,030 | 11/1990 | Tokunaga et al. | 399/347 |
| 4,978,999 | 12/1990 | Frankel et al. | 399/350 |
| 5,122,839 | 6/1992 | Siegel et al. | 399/347 |
| 5,138,395 | 8/1992 | Lindblad et al. | 399/346 |
| 5,349,429 | 9/1994 | Jugle et al. | 399/346 |
| 5,617,194 | 4/1997 | Morishita et al. | 399/349 |
| 5,765,088 | 6/1998 | Nakayama et al. | 399/350 |
| 5,915,156 | 6/1999 | Kizaki et al. | 399/350 X |

*Primary Examiner*—Matthew S. Smith
*Attorney, Agent, or Firm*—Fitzpatrick, Cella, Harper & Scinto

[57] ABSTRACT

In order to prevent uneven shaving of a light receiving member and fusion of a developer, a surface of the light receiving member after development and transfer of the developer is scrape-cleaned with an elastic rubber blade, the wear loss of the light receiving member after copying steps on transfer sheets is within a range of not less than 1 Å/10,000 rotations nor more than 10 Å/10,000 rotations.

43 Claims, 7 Drawing Sheets

CLEANING DEVICE FOR ELECTROPHOTOGRAPHIC APPARATUS, ELECTROPHOTOGRAPHIC APPARATUS, METHOD FOR CLEANING LIGHT RECEIVING MEMBER OF ELECTROPHOTOGRAPHIC APPARATUS, AND ELECTROPHOTOGRAPHIC PROCESS COMPRISING THE CLEANING METHOD

BACKGROUND OF THE INVENTION

1. Field of the Invention

The present invention relates to a cleaning device for electrophotographic apparatus, an electrophotographic apparatus, a cleaning method for cleaning a light receiving member of the, electrophotographic apparatus, and an electrophotographic process having the cleaning method and, more particularly, to a cleaning device for implementation of scrape-cleaning using a cleaning blade, an electrophotographic apparatus therewith, a cleaning method for cleaning a light receiving member of the electrophotographic apparatus, and an electrophotographic process having the cleaning method.

2. Related Background Art

Materials for the light receiving member used as an electrophotographic, light receiving member include a variety of materials suggested heretofore, for example, such as inorganic materials including selenium, cadmium sulfide, zinc oxide, amorphous silicon (hereinafter referred to as a-Si), and so on, or organic materials. Among these materials, non-monocrystalline deposited films containing the silicon matrix, typified by a-Si, for example amorphous deposited films of a-Si containing hydrogen and/or halogen (for example, fluorine, chlorine, or the like) for compensating dangling bonds were suggested as high-performance, highly durable, and nonpolluting light receiving members, some of which are in practical use. For example, U.S. Pat. No. 4,265,991 discloses the technology of the electrophotographic, light receiving member whose photoconductive layer is formed mainly of a-Si. Further, for example, Japanese Patent Application Laid-Open No. 60-12554 discloses a surface layer containing carbon and halogen atoms on a surface of the photoconductive layer made of amorphous silicon containing silicon atoms.

As methods for forming the silicon-based non-monocrystalline deposited films, there are many known methods, including sputtering methods, methods of decomposing a source gas by heat (thermal CVD), methods of decomposing the source gas by light (photo CVD), methods of decomposing the source gas by a plasma (plasma CVD), and so on. Among them, the plasma CVD methods, which are methods for decomposing the source gas by glow discharge or the like generated by direct current or high-frequency wave (RF or VHF) or microwave to deposit a deposited film on a desired substrate of glass, quartz, heat-resistant synthetic resin film, stainless steel, aluminum, or the like, are in a very advanced stage of practical application at present, not only to the methods for forming the amorphous deposited films for electrophotography etc., but also to methods for forming deposited films for the other uses, and a variety of devices therefor also have been suggested heretofore.

Further, as to the application to the light receiving members for electrophotography, there are strong desires for improvement in the quality of film and in the processing performance in recent years and various ideas and means have been studied.

Particularly, a plasma process using high-frequency power has various advantages of high stability of discharge, applicability to formation of insulating materials such as oxide films, nitride films, and the like, and so on, and thus is used because of the advantages.

With the light receiving members, there are recent demands for improvement in electrophotographic characteristics ready for high-speed operation and for the image quality of higher definition. Under such circumstances, in addition to the improvement in the characteristics of the light receiving members, the grain sizes of developers are being decreased to smaller sizes and commonly used developers have a weight average diameter by a coulter counter or the like in the range of 5 to 8 $\mu$m.

There are also various types of developers, depending upon uses, and more models have been employing one-component developers recently, because they are free of deterioration and replacement of carriers and thus permit compactification of a developing device. These developers are made as follows. A resin with a magnetic material dispersed therein is synthesized or crushed in a spherical shape having the weight average diameter of about 3 to 15 $\mu$m, or in indefinite shapes to form matrices-called classified particles and, in order to add a further function, powder, called an externally attached agent, of the submicron order is attached to the surface thereof. More specifically, the magnetic material is, for example, magnetite, the resin is, for example, polystyrene, polyester, or polybutadiene, and the externally attached agent is, for example, alumina, silica, strontium titanate, or the like.

Mechanisms at the time of occurrence of fusion of the developer are generally classified under two types; a type of precipitation of the externally attached agent in a film form and a type of adhesion of the classified particles fused.

Since the a-Si light receiving members have high surface hardness, they scarcely suffer degradation of image quality due to the reason of excess shaving of the surface of the light receiving member after repetitive use in ordinary use circumstances. However, the surface of the a-SI light receiving members sometimes has projections due to abnormal growth in the production process thereof. Most of the projections have heights of approximately 2 to 3 $\mu$m, but a few projections could have heights over 10 $\mu$m. Such projections could damage a cleaning blade. Particularly, a cleaning blade with increased hardness was fragile and was sometimes chipped when damaged at the process speed over 400 mm/sec (which will be called blade chipping hereinafter).

For preventing the blade chipping, a sufficient prevention effect can be achieved, for example, up to about 600 $\mu$m/sec by limiting the heights of projections to below 5 to 6 $\mu$m. An effective method for implementing it is to process the surface of the light receiving member by polishing means. As for prevention of the fusion of developer, however, it was the status that an improvement in the quality of blade material was expected.

It is also contemplated that the surface of the a-Si light receiving members is scrubbed with the blade itself (5 to 10 Å/10,000 copies) and/or with an elastic cleaning roller or the like (about 25 to 50 Å/10,000 copies) for removal of transfer or the like of ozone products, thereby removing them. There are, however, desires for efforts toward further stabilization of quality as to the fusion of the developer under the recent circumstances of the decrease in the grain sizes of developers and the increase in the process speed such as the copy speed or the like.

Under such circumstances there are desires for a cleaning system preferably applicable to high-speed electrophotographic apparatus ready for high image quality.

A cleaning method popularly used for cleaning the a-Si base light receiving members is a blade type cleaning method which has high cleaning performance as a cleaning means in general.

This blade type cleaning method, however, could cause uneven shaving of the surface layer of the light receiving member in some cases because of differences in amounts of the developer staying on the blade surface, depending upon differences of character patterns on an original chart. When such uneven shaving occurs, differences are made in incident light amounts because of interference to cause sensitivity unevenness as an electrophotographic characteristic and in turn cause density irregularities of an image in some cases.

Particularly, this phenomenon of the density irregularities becomes more prominent as the grain sizes of the developer become smaller.

There are, however, recent desires for improvement in the image characteristics to higher image quality and the grain sizes of the developer are becoming smaller and smaller under such circumstances. This decrease of the grain sizes of the developer improves the image quality on one hand, but tends to increase the scrubbing power on the other hand. This increase of the scrubbing power could cause passing-through of the residual developer (toner) due to chatter or the like of the cleaning blade and sometimes causes a cleaning failure of a black line pattern.

Further, if frictional resistance is high, frictional heat will rise between the light receiving member and the cleaning blade and there will arise a possibility of the fusion phenomenon that the residual developer used in thermal fixation is firmly attaches to the surface of the light receiving member because of the frictional heat. Particularly, this fusion phenomenon tends to become more prominent in proportion to the decrease in the grain sizes of the developer; it is too trivial to affect the image at the initial stage, but repetitive use could result in gradual growth of fusion around nuclei of small fused developer and forming an image defect of a black line pattern in the image in certain cases.

In addition, as digitization is advanced with development of computers, the percentage of laser printers is also Increasing in the field of electrophotography. A significant feature of such digital copiers is the so-called reverse development in which the developer is placed on only print areas with a laser or an LED array. Since in this development the developer is laid on low-potential portions of the light receiving member, application amounts of the developer in the cleaner part are larger than in the case of analog machines employing the normal development, and it could be a significant cause of promoting the abrasion and the fusion of developer.

It is not easy for users themselves of the electrophotographic apparatus to recover such uneven shaving or fusion. Therefore, a work of serviceman or the like is necessitated, which posed challenges of expense including the cost for replaced parts, the labor cost, etc. and time loss due to stop of the electrophotographic apparatus during the work. They are typical challenges in the electrophotographic apparatus and are significant challenges, which could cause increase of running cost, particularly, in high-speed machines.

Examples of conceivable solutions to such challenges under such circumstances are measures including a method of increasing the urging pressure of the cleaning blade, a method of increasing the hardness of the elastic rubber blade in order to increase the force for scraping off the developer attached to the surface of the light receiving member, and so on. Increasing the hardness of the blade changes the property of the blade from a rubber-like state to a glass state and thus makes the material fragile, so as to shorten the lifetime of the blade. Further, the above methods tend to Increase the frictional force against the surface of the light receiving members so that there are some cases in which the uneven shaving of the surface layer is rather degraded.

SUMMARY OF THE INVENTION

The present invention has been accomplished in is order to solve the above-stated problems including the degradation of uniformity of image due to the uneven shaving of the surface layer and the fusion of the developer to the light receiving layer, and an object of the invention is to provide a cleaning method and an electrophotographic process free of the occurrence of fusion of the developer and a cleaning device and an electrophotographic apparatus capable of implementing the method and process, by (1) making the surface of the light receiving member uniformly worn without the uneven shaving and by (2) suppressing the growth of fused substances on the light receiving member and/or facilitating peeling-off of the fused substances, even in an electrophotographic process in which the development is carried out with a developer of small grain size and the surface layer is gradually worn by a cleaning method with scrubbing means such as a cleaning roller or the like.

According to a first aspect of the present invention, there is provided a cleaning device of an electrophotographic apparatus, the electrophotographic apparatus being arranged to rotate a light receiving member at 400 to 600 mm/sec and successively repeat charging, exposure, development, transfer, and cleaning, the light receiving member being subjected to development and transfer of a developer onto a transfer medium and thereafter a surface of the light receiving member being scrape-cleaned with an elastic rubber blade, wherein the wear loss of the light receiving member after copying steps on transfer sheets is within a range of not less than 1 Å/10,000 rotations nor more than 10 Å/10,000 rotations, and an electrophotographic apparatus having the cleaning device.

According to a second aspect of the present invention, there is provided a cleaning device of an electrophotographic apparatus, the electrophotographic apparatus being arranged to rotate a light receiving member at 300 to 500 mm/sec and successively repeat charging, exposure, development, transfer, and cleaning, the electrophotographic apparatus being arranged to subject the light receiving member to development and transfer of a developer and scrape-clean a surface of the light receiving member with an elastic rubber blade after the developer is applied in 0.4 to 0.6 mg/cm$^2$ onto the light receiving member with a roller provided upstream of the elastic rubber blade, wherein the wear loss after A4-size copying steps on transfer sheets is within a range of not less than 1 Å/10,000 rotations nor more than 10 Å/10,000 rotations, and an electrophotographic apparatus having the cleaning device.

According to a third aspect of the present invention, there is provided a cleaning method of an electrophotographic apparatus, which comprises scrape-cleaning a surface of a light receiving member with an elastic rubber blade while moving the light receiving member and the elastic rubber blade relative to each other at a relative speed of 400 to 600 mm/sec, wherein the wear loss of the light receiving member is within a range of not less than 1 Å10,000 rotations nor more than 10 Å/10,000 rotations, and an electrophotographic process comprising the cleaning method.

According to a fourth aspect of the present invention, there is provided a cleaning method of an electrophotographic apparatus, which comprises scrape-cleaning a surface of a light receiving member with an elastic rubber blade while moving the fight receiving member and the elastic rubber blade relative to each other at a relative speed of 300 to 500 mm/sec, wherein the wear loss of the light receiving member after application of developer in 0.4 to 0.6 mg/cm$^2$ and execution of the scrape-cleaning is within a range of not less than 1 Å/10,000 rotations nor more than 10 Å/10,000 rotations, and an electrophotographic process comprising the cleaning method.

DESCRIPTION OF THE PREFERRED EMBODIMENTS

Figure 1:
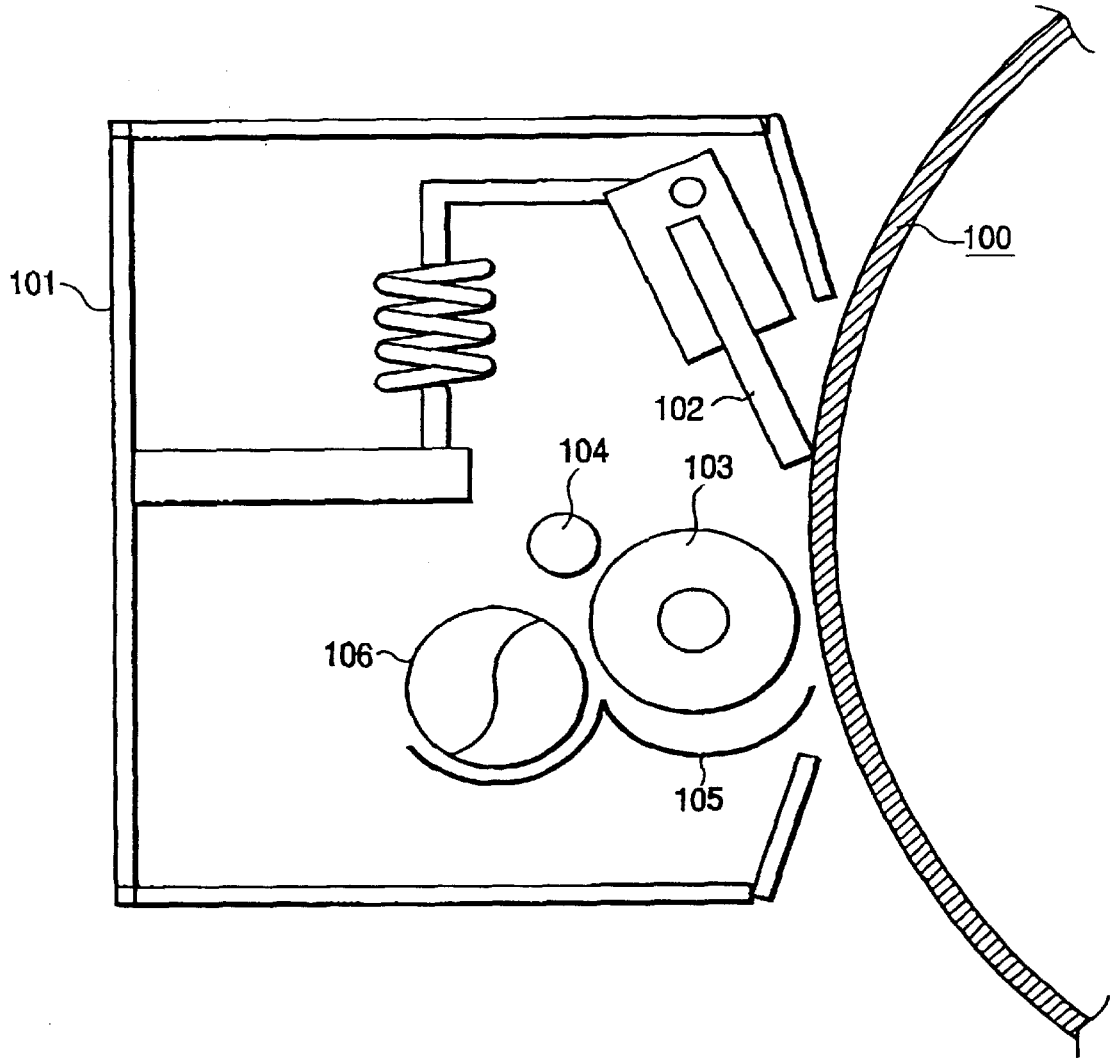
FIG. 1 is a schematic, structural view showing a preferred example of the cleaning device.

Noting the relationship between the electrophotographic process and wear loss of the surface layer of the light receiving member, the inventors attempted to "control" change in the surface property due to wear of the surface of the light receiving member in a severe electrophotographic process as to the uneven shaving.

Specifically, as to the aforementioned uneven shaving and fusion occurring with progress in the number of copies, factors associated with the occurrence thereof were extracted out of those varying according to the number of copies and the combination of the structure of the cleaner with the characteristics of the light receiving member was so optimized as to cancel out variations of the factors according to the progress in the number of copies.

Namely, the inventors made efforts to find out such a condition as to always overcome the aforementioned problems at each time of proceeding of endurance test, by controlling microscopic physical properties of the surface layer inevitably wearing with progress in the number of copies and macroscopic variations of frictional torque and rebound behavior of the blade against the substance adhering to the light receiving member by selection of the material for the surface layer of the light receiving member As a result, the present invention substantiated such a control as to prevent the uneven shaving, the cleaning failure, and the fusion from occurring, by a combination of the electrophotographic process of the present invention with the light receiving member obtained by applying the non-monocrystalline hydrogenated carbon film (a-C:H) of the present invention to the surface layer of the light receiving member.

Namely, the present invention is such that where. the surface of the light receiving member is scrape-cleaned with an elastic rubber blade, the wear loss of the surface after execution of A4-size copying steps on transfer sheets is within the range of not less than 1 Å/10,000 rotations nor more than 10 Å/10,000 rotations.

More specifically, the electrophotographic apparatus of the present invention is an electrophotographic apparatus arranged to rotate a light receiving member at 400 to 600 mm/sec and successively repeat charging, exposure, development, transfer, and cleaning, the electrophotographic apparatus being arranged to subject the light receiving member to development and transfer to a transfer medium and to scrape-clean the surface of the light receiving member after the transfer of developer with an elastic rubber blade, wherein the wear loss after completion of A4-size copying steps on transfer sheets is within a range of not less than 1 Å/10,000 rotations nor more than 10 Å/10,000 rotations.

The mechanisms at the time of occurrence of the fusion of developer are generally classified under two types, the type of precipitation of the externally attached agent in a film form and the type of adhesion of the classified particles fused. Particularly, in the case of the former type, a preferred arrangement is an electrophotographic apparatus arranged to rotate a light receiving member at 300 to 500 mm/sec and successively repeat charging, exposure, development, transfer, and cleaning in such a structure that the light receiving member is subjected to development arid transfer to a transfer sheet, a roller is provided upstream of the elastic rubber blade with respect to the surface of the light receiving member after the transfer of developer, and the developer is applied in 0.4 to 0.6 mg/cm$^2$ to the light receiving member with the roller, wherein the wear loss after completion of A4-size copying steps on transfer sheets is within a range of not less than 1 Å/10,000 rotations nor more than 10 Å/10,000 rotations.

It is also preferable to use the developer having a weight average particle diameter within a range of 5 to 8 $\mu$m; it is also preferable that the aforementioned light receiving member have a surface layer of a non-monocrystalline SiC film containing hydrogen or a non-monocrystalline hydrogenated carbon film (a-C:H); or it is also preferable that the aforementioned elastic rubber blade be an elastic rubber blade having such characteristics that the modulus of repulsion elasticity at a temperature in a temperature range of 15 to 30° C. is a value within a range of 5 to 15%, the modulus of repulsion elasticity at a temperature in a temperature range of 30 to 45° C. is a value within a range of 10 to 20%, and JIS A hardness (Hs) is not less than 77 nor more than 85.

In addition, it is desirable that the aforementioned elastic rubber blade have a temperature dependence of the modulus of repulsion elasticity within a range of −1%/deg to +1%/deg in a temperature range of 10 to 50° C., more preferably, within a range of 15 to 45° C.; it is also desirable that a roller be further provided upstream of the elastic rubber blade and that the developer be applied in 0.03 to 0.3 mg/cm$^2$ onto the light receiving member; it is also desirable that the surface roughness of the light receiving member be Rmax not less than 0.3 $\mu$m nor more than 5.0 $\mu$m and that the light receiving member be used after undergoing a polishing process to reduce heights of abnormally grown projections to not more than 5.0 μm; or it is also desirable that a hydrogen content of the aforementioned non-monocrystalline hydrogenated carbon film be 41% to 60%.

Further, the present invention provides a cleaning method and process of an electrophotographic apparatus arranged to rotate a light receiving member at 400 to 600 mm/sec and successively repeat charging, exposure, development, transfer, and cleaning, the, electrophotographic apparatus being arranged to subject the light receiving member to development, transfer to a transfer medium, and scrape-cleaning of the surface of the light receiving member after the transfer of developer with an elastic rubber blade, wherein the wear loss after completion of A4-size copying steps on transfer sheets is within a range of not less than 1 Å/10,000 rotations nor more than 10 Å/10,000 rotations and wherein control is effected on change of the surface property due to wear of the surface of the light receiving member.

Another cleaning method and process is a cleaning method and process of an electrophotographic apparatus arranged to rotate a light receiving member at 300 to 500 mm/sec and successively repeat charging, exposure, development, transfer, and cleaning, the electrophotographic apparatus being arranged to apply a developer in 0.4 to 0. 6 mg/cm$^2$ to the light receiving member and scrape-clean the light receiving member with an elastic rubber blade, wherein the wear loss after completion of A4-size copying steps on transfer sheets is within a range of not less than 1 Å/10,000 rotations nor more than 10 Å/10,000 rotations and wherein control is effected on change of the surface property due to wear of the surface of the light receiving member.

Further, similar to the above, it is preferable to use the developer having a weight average diameter within a range of 5 to 8 μm; it is also preferable that the aforementioned light receiving member have a surface layer of a non-monocrystalline SiC film containing hydrogen or a non-monocrystalline hydrogenated carbon film (a-C:H); it is also preferable that the aforementioned elastic rubber blade be an elastic rubber blade having such characteristics that the modulus of repulsion elasticity at a temperature in a temperature range of 15 to 30° C. is a value within a range of 5 to 15, the modulus of repulsion elasticity at a temperature in a temperature range of 30 to 45° C. is a value within a range of 10 to 20%, and JIS A hardness is not less than 77 nor more than 85; it is also preferable that the elastic rubber blade have a temperature dependence of the modulus of repulsion elasticity within a range of −1%/deg to +1%/deg in a temperature range 10 to 50° C., more preferably, in a temperature range of 15 to 45° C.; it is also preferable that the applying step be a step of applying the developer in 0.03 to 0.3 mg/cm$^2$ to the light receiving member repeatedly subjected to the successive steps of the charging, exposure, development, transfer, and cleaning, it is also preferable that the surface roughness of the light receiving member be Rmax not less than 0.3 μm nor more than 5.0 μm and that the light receiving member be used after undergoing a polishing process to reduce heights of abnormal grown projections to not more than 5.0 μm; or it is also preferable that a hydrogen content of the aforementioned non-monocrystalline hydrogenated carbon film be 41% to 60%.

The term "modulus of repulsion elasticity" as used in the specification and claims refers to cushioning properties of an elastic member. The modulus of repulsion elasticity is determined by the modulus of repulsion elasticity test based on JIS (Japanese Industrial Standard) K 6301. Specifically, a test piece of an elastic member is held on a support of a modulus of repulsion elasticity testing machine such that a surface of the test piece is in the vertical direction. Then, a horizontally suspended round bar is allowed to fall freely from a predetermined height to collide perpendicularly with the surface of the test piece to thereby rebound. The modulus of repulsion elasticity is defined as the percentage of the rebound height of the horizontally suspended round-bar relative to the predetermined height (i.e., the falling height of the bar).

The modulus of repulsion elasticity is an important parameter in the present invention and a blade with a lower modulus functions well to scrape off the fused toner on the surface of the light receiving member, thus having higher fusion-eliminating performance. It is also preferable to give consideration to a temperature dependence of the modulus of repulsion elasticity adaptable for changes of room temperature or the like during the period of time before stabilization of temperature, for example, during the initial stage after power on of a heater in the case of a system provided with the heater for heating the light receiving member in order to prevent the image flow at high humidity or adaptable for changes of room temperature or the like due to air conditioning or seasonal variations in the case of a system without a heater for heating the light receiving member.

The hardness (Hs) of the blade is measured as follows. A press surface having a hole through which a push needle comes out and having a plane normal to the needle is put in contact with a surface of a test piece whereupon the push needle projecting out because of spring force through the hole provided in the center of the press surface is pushed back by the test piece. A distance of movement of the test piece thus pushed back is measured as a hardness. The hardness is measured and expressed according to the method specified in Japanese Industrial Standard JIS K6301.

The tip of the needle is circular in the diameter of 0.79±0.02 mm.

If the hardness of the blade exceeds 85, the material of the blade will become fragile, so as to shorten the lifetime of the blade. If the hardness is below JIS hardness 69, there will arise problems including degradation of the cleaning property, rolling of the blade to damage the surface of the light receiving member, and so on.

In the present invention, the light receiving member also comprises a surface layer. Specifically, a preferred material is the amorphous carbon containing hydrogen (a-C:H), as described previously, and an a-C:H film suitably applicable is one having a hydrogen content in film in the range of 41% to 60% based on H/(C+H) and preferably in the range of 45% to 55%. If the hydrogen content is not more than 40%, the material will be sometimes unsuitable for the electrophotographic apparatus from the aspect of sensitivity. If the hydrogen content is over 60%, the material will be sometimes unsuitable for the electrophotographic apparatus because of degraded denseness of film and mechanical strength.

Further, when the surface layer is made of a material selected so as to have the hydrogen content in the above range and to meet the aforementioned condition that the wear loss after completion of A4-size copying steps on transfer sheets is in the range of not less than 1 Å/10,000 rotations nor more than 10 Å/10,000 rotations, the chatter of the blade due to friction becomes little and partial stress can be suppressed on the blade contact surface, thereby relaxing partial residence of the developer. As a result, it was found that the surface layer was worn uniformly without uneven shaving. One rotation of a drum-shape light receiving member is just one rotation thereof exactly and one rotation of a belt-shape light receiving member can be considered to be movement up to appearance of the same position.

If the wear loss of the surface layer of the light receiving member used in the present invention is greater than 10 Å/10,000 rotations, the mechanical strength could be degraded in certain cases; if it is smaller than 1 Å/10,000 rotations the surface layer will become resistant to wear so as to weaken the scraping-off effect of the corona discharge products, sometimes resulting in occurrence of the image smearing.

Further, the optimum thickness of the surface layer used in the light receiving member of the present invention can be determined from the relationship between the wear loss of the surface layer and the lifetime of the electrophotographic apparatus, but it is desirable to determine it generally in the range of 0.01 μm to 10 μm and preferably in the range of 0.1 μm to 1 μm. If the thickness of the surface layer is not more than 0.01 μm the mechanical strength could be degraded; if it is not less than 10 μm the residual potential could become too high.

Further, it is desirable to determine the thickness of the photoconductive layer used in the light receiving member of the present invention generally in the range of 35 μm to 50 μm and preferably in the range of 40 μm to 50 μm. When compared with a metal conductive substrate, the relative permittivity of the entire a-Si light receiving member is smaller, about 10, and particularly, the relative permittivity of the a-C surface layer part is much smaller, about 6, so that the effect of decreasing the adhering force cf the developer of the decreased grain sizes is enhanced more as the thickness of the light receiving member becomes larger. If the thickness of the photoconductive layer is not more than 35 μm the releasing effect of the developer could be insufficient; if it is not less than 50 μm the spherical projections could become higher.

The surface roughness of the light receiving member is also an important parameter and it was found out that, particularly in the limited range of surface roughness, the frictional torque of the cleaner and the surface free energy of the light receiving member varied in conjunction according to the progress in the number of copies, so as to demonstrate such behavior as to cancel out the cause of occurrence of the fusion of developer.

Summarizing the above, the surface layer of a-SiC has such characteristics as to be worn more than before with the smaller-size developer to degrade the free energy and essentially become apt to cause the fusion of developer, and the fusion is scraped off by torque; whereas the surface layer of a-C has such characteristics as to cause little wear to rarely degrade the free energy, and the fusion can be scraped off without increase of the torque. A point common to the both is that it is preferable to use the blade with a low modulus of repulsion elasticity and a high viscosity so as to avoid chipping thereof.

The present invention will be described in detail with reference to the drawings.

[Cleaning device]

FIG. 1 is an enlarged view of a cleaning device as a main unit of the present invention.

The cleaning means has, for example as in a cleaning device 101 of FIG. 1, a light receiving member 100, a cleaning blade 102 made of urethane rubber or the like, a cleaning roller 103 made of a material selected from silicone rubber, sponge, magnetic materials, and so on, a doctor roller 104, a waste toner receiver 105, a waste toner transfer system 106, etc. as occasion may demand.

This doctor roller 104 is provided if necessary and it can also be provided in the form of a blade shape. In this case, it is called a scraper (or a doctor blade).

In the following description of the members of the cleaning device, the description of the scraper will be omitted for simplicity of explanation.

Numeral 101 designates the cleaning device, in which the cleaning blade 102 with appropriate elasticity and hardness, for example, made of a mixture of urethane rubber with a silicon compound is disposed.

The cleaning roller 103 is located upstream of the cleaning blade 102 in the rotating direction of the light receiving member. The cleaning roller 103 is coated with magnetic powder mainly of the collected toner or the like adhering thereto by magnetic force or adhesive force. The coat part of the magnetic powder adhering to the roller is in contact with the surface of the light receiving member across an appropriate contact width (called a nip width) and is arranged to scrub the light receiving member at predetermined relative speed and coat the light receiving member 100 with the waste toner.

The cleaning roller 103 can also be a roller to which a bias having the opposite polarity to the toner is applied or a roller made of a material selected from silicone rubber, sponge-like resin, or the like, as well as the magnet.

The cleaning roller 103 does not always have to be formed in the roller shape, but may also be formed as a brush-shape member. The brush-shape member is preferably made of a material properly selected depending upon the hardness of the light receiving member used, the process speed, and so on.

Examples of brush materials used for the high-hardness light receiving members, such as the a-Si base light receiving members or the like, include chemical fiber brushes of polyethylene, polystyrene, and so on, brushes using electrically conductive fibers obtained by mixing carbon in the chemical fibers so as to impart an appropriate conductive property, brushes using amorphous metal fibers (for example, Borfur (trade name) available from Unitika, etc.), and so on.

[Electrophotographic apparatus]

FIG. 2is a schematic view showing an example of an analog copying machine.

Around the light receiving member 201 rotating in the direction of arrow X there are provided a primary charger 202, an electrostatic latent image forming section 203, a developing unit 204, a transfer sheet supply system 205, a transfer charger 206*a*, a separation charger 206*b*, a cleaner 207, a conveying system 208, a charge eliminating light source 209, and so on. The light receiving member 201 may be subject to temperature control by a surface-shape inside heater 225 as occasion may demand.

The surface of the light receiving member 201 is uniformly charged by the primary charger 202 and an electrostatic latent image is formed thereon by the image exposure means.

Light from a halogen lamp 210 as a light source is projected to scan an original 212 mounted on an original platen 211 and reflected light from the original 212 is reflected by mirrors 213, 214, 215 to be guided through lenses 218 of a lens system 217 and via a mirror 216 to be focused on the light receiving member 201, thereby forming the aforementioned electrostatic latent image.

This electrostatic latent image is developed to a toner image by a developing sleeve of the developing unit 204 coated with the developer (toner).

On the other hand, a transfer sheet P is supplied through the transfer sheet supply system 205 including a supply guide 219 and supply rollers 222 and the toner image is transferred onto the transfer sheet P. The transfer sheet P is separated from the light receiving member 201 by the separation charger 206(*b*) and/or a separating means such as a claw or the like (not illustrated) and is conveyed via the conveying system 208 into a fixing unit 223. The surface toner image on the transfer sheet P is fixed by fixing rollers 224 in the fixing unit 223 and thereafter the transfer sheet is discharged out of the image forming apparatus.

On the other hand, the surface of the light receiving member 201 after the transfer of the toner image is cleaned by removing attached substances such as the residual toner, paper powder, etc. from the surface by the cleaning blade 220 and cleaning roller (or brush) 221 in the cleaning device 207, and thereafter it is ready for the next image forming.

Numeral 226 denotes a blank exposure light source.

Figure 3:
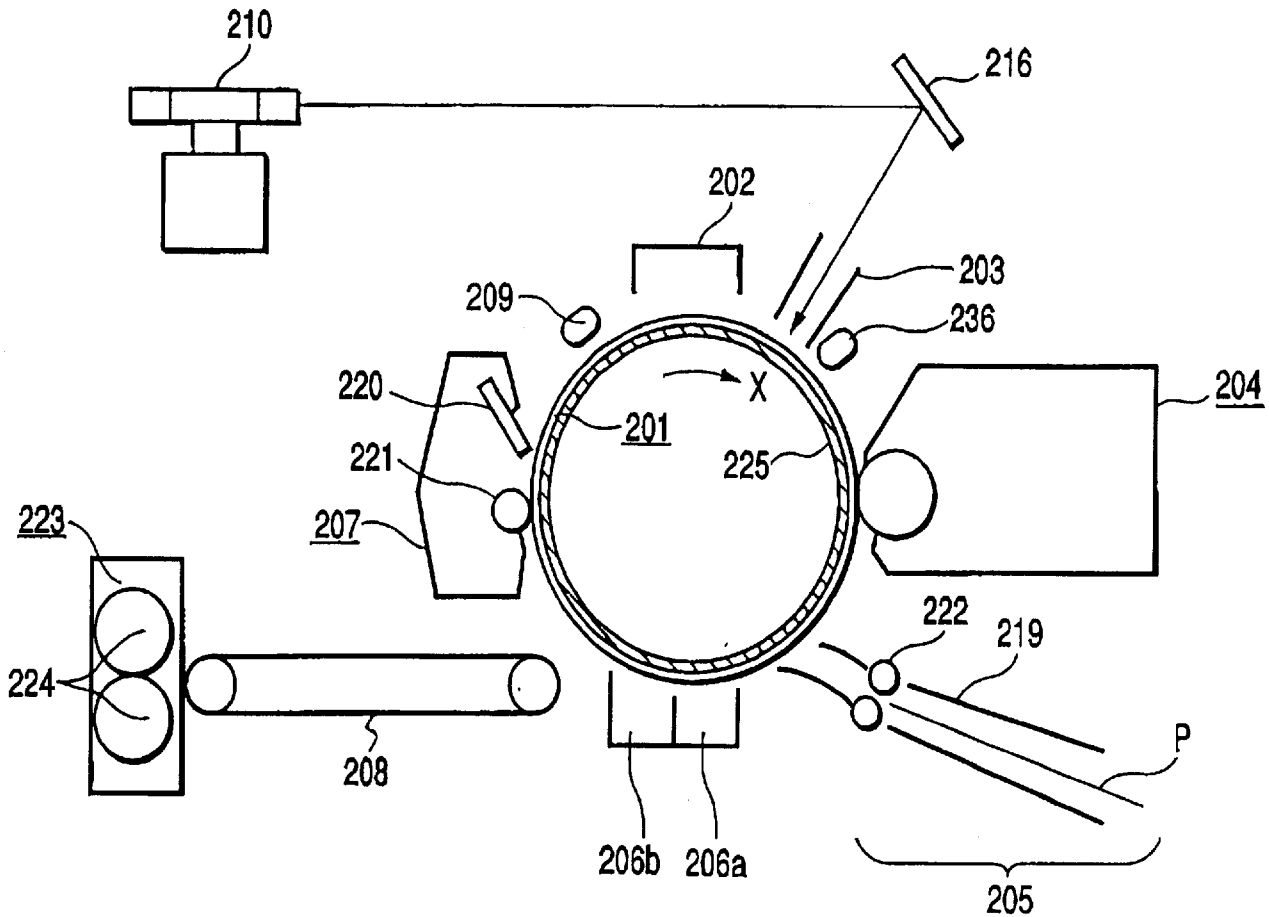
FIG. 3 is a schematic, structural view showing another preferred example of the electrophotographic apparatus as an image forming apparatus using the electrophotographic method.

FIG. 3 is a schematic, structural view for explaining an example of a digital printer (for example, an LBP (laser beam printer)) as an example of the electrophotographic apparatus.

Figure 2:
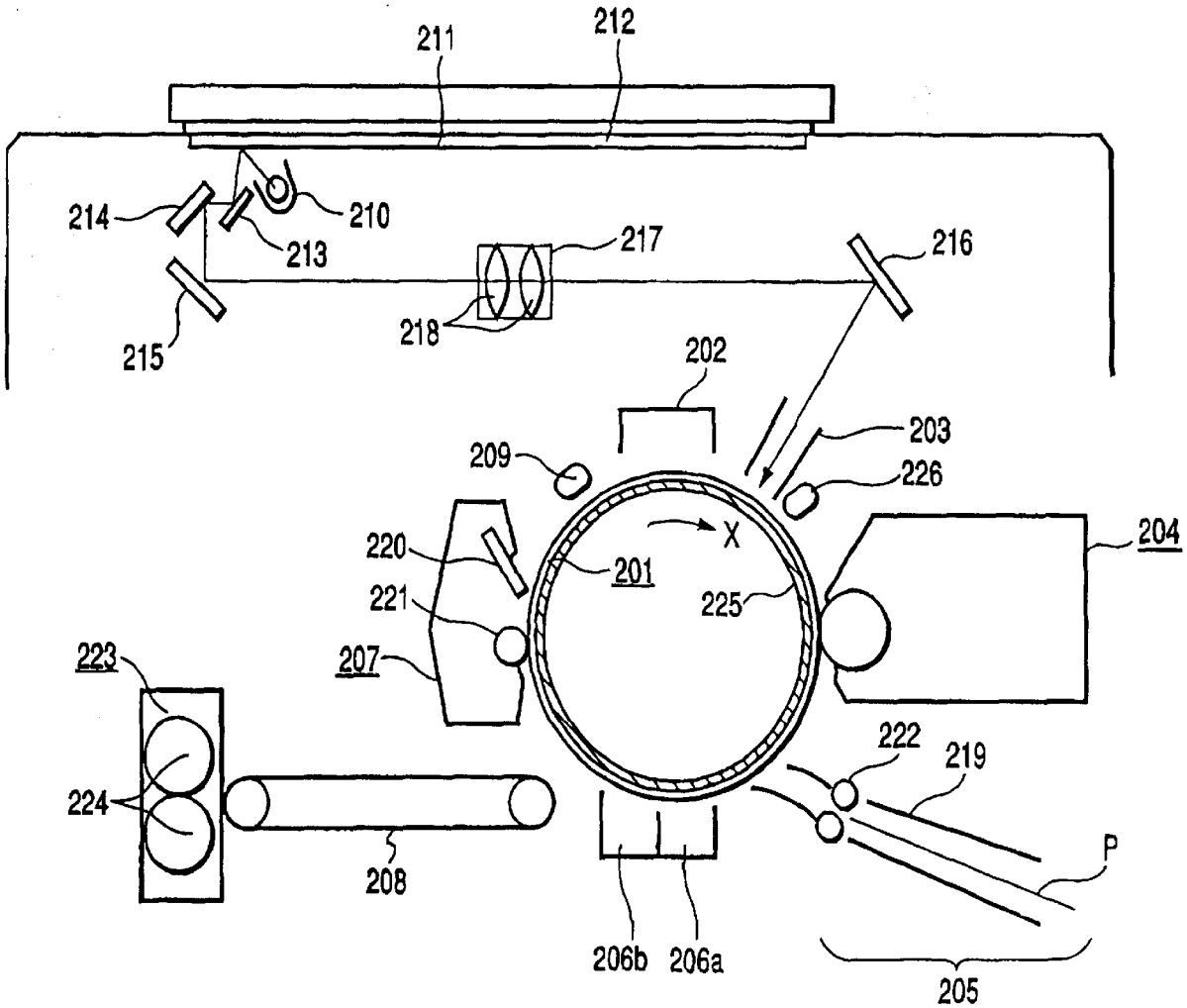
FIG. 2 is a schematic, structural view showing a preferred example of the electrophotographic apparatus as an image forming apparatus using the electrophotographic method.

In FIG. 3, members having the same reference numerals as those in FIG. 2 represent the same members as those described in FIG. 2, and thus the detailed description thereof is omitted herein.

In FIG. 3 the image information is guided via a deflector (for example, a rotary polygon mirror) 210 for deflecting light from a laser light source not illustrated to scan the light receiving member 201 in the longitudinal direction with the light. The light deflected by the deflector 210 is reflected by the mirror 216 to irradiate the light receiving member 201 In FIG. 3 reference numeral 236 represents a sensor for measuring the surface potential.

Figure 4:
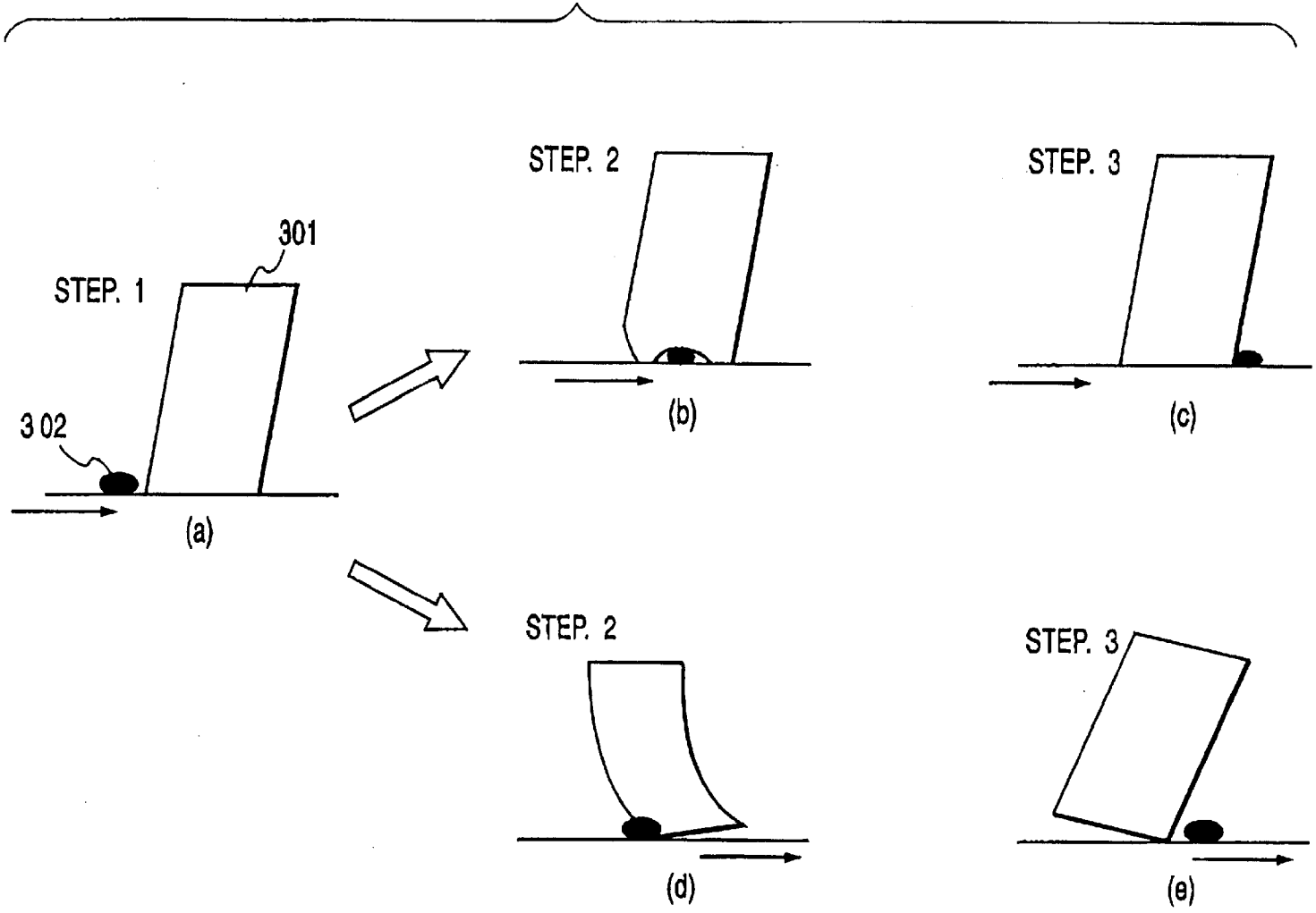
FIG. 4 is a schematic, explanatory view for explaining examples of behavior of the blade.

FIG. 4 is a view to illustrate the consideration on the mechanism for preventing the fusion of the developer 302 by the elastic blade 301. The cleaning blade used in the present invention has such hardness that the modulus of repulsion elasticity at a temperature of 15 to 30° C. is in the range of 5 to 15%, the modulus of repulsion elasticity at a temperature of 30 to 45° C. is in the range of 10 to 20%, and the JIS A hardness (Hs) is not less than 77 nor more than 85. It is considered that deformation of the blade itself is small and it behaves so as to scrape off the fused part of developer, as illustrated in (a), (b), and (c) of FIG. 4. In contrast, if the cleaning blade is made so as to have such hardness that the modulus of repulsion elasticity at a temperature of 15 to 30° C. is approximately 30%, the modulus of repulsion elasticity at a temperature of 30 to 45° C. is approximately 60%, and the JIS A hardness (Hs) is not less than 69 nor more than 77, the developer will be dragged or the blade Itself will be deformed to jump, as illustrated in (a), (d), and (e) of FIG. 4.

From this mechanism, the abnormal projections specific to the a-Si light receiving members could cause a disadvantage of breakage of the blade on the contrary, because they are much harder than the developer fusion. It is thus preferred to employ a polishing process to polish the surface of the light receiving member to Rmax not more than 5 μm as well, as described in Japanese Patent Publication No. 7-010488.

Figure 5B:
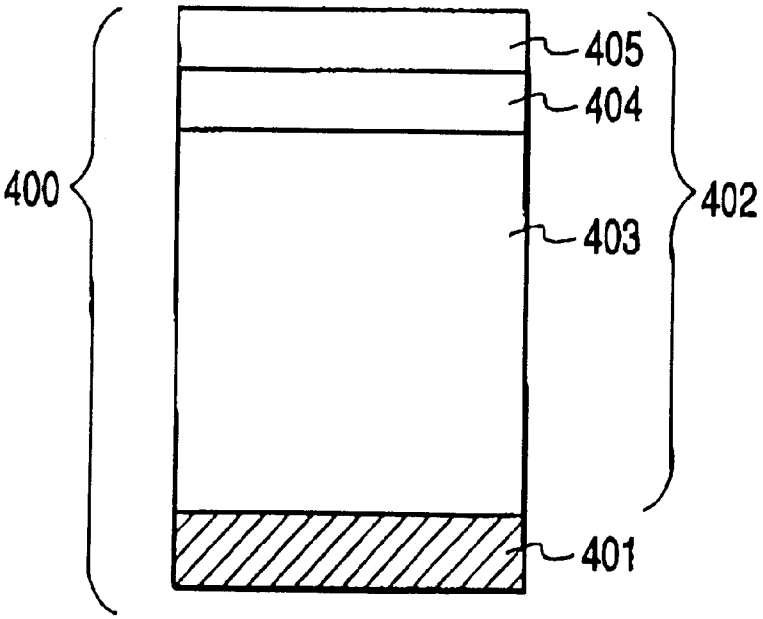
FIGS. 5A and 5B are schematic, sectional views, each explaining an example of the structure of the light receiving member.
Figure 5A:
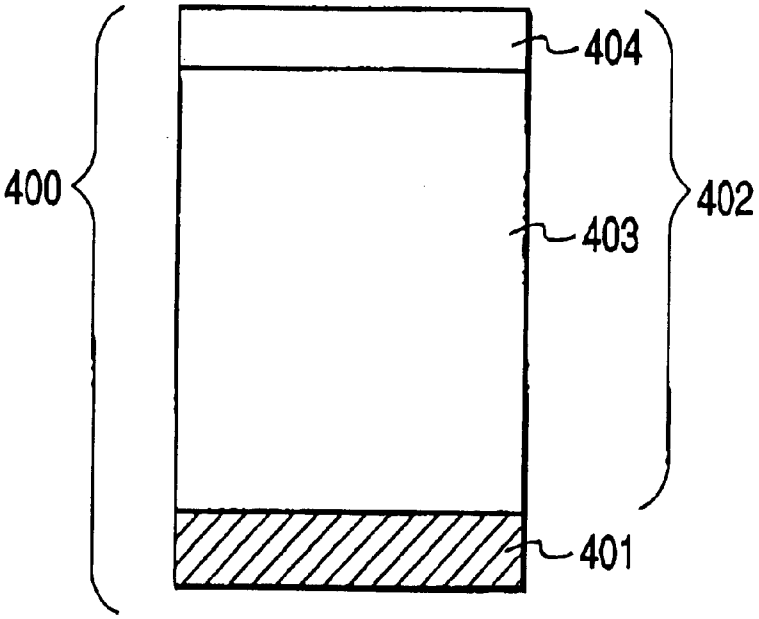

FIGS. 5A and 5B are schematic, sectional views showing examples of the light receiving members applicable to the present invention.

The a-Si base light receiving member 400 illustrated in FIG. 5A is a light receiving member having a photosensitive layer (light receiving layer) 402 on an electroconductive substrate 401 of aluminum or the like, the photosensitive layer 402 being formed in such a structure that a photoconductive layer 403 comprised of an amorphous material containing at least silicon atoms is laid on the conductive substrate 401 and a surface layer 404 comprised of an a-C:H film containing carbon atoms and hydrogen atoms or an a-SiC:H film is further laid thereon.

FIG. 5B shows another structure in which a surface layer 405 comprised of an a-C:H film containing carbon atoms and hydrogen atoms is further laid on the light receiving member of FIG. 5A having the surface layer 404 of the a-SIC:H film. It is more preferable that the hydrogen content of the a-C:H film be 41% to 60%, as described previously.

It is a matter of course that the photoconductive layer 403 may have a charge injection inhibiting layer containing an element belonging to Group III or Group V of the periodic table on the substrate 401 side or on the surface layer 404 side.

The light receiving layer 402 can be made by a chemical vapor deposition process, for example, such as a plasma CVD process or the like.

The light receiving layer of the light receiving member by the forming method such as the plasma CVD process can be formed by use of known means, but it is particularly preferable to supply high-frequency power of the frequency 1 MHz to 45 MHz, so called VHF band power, from a high-frequency power supply to bring about high-frequency glow discharge in order to enhance the cleaning performance of the light receiving layer, particularly, of the surface layer.

The present invention will be described in more detail with examples thereof, but it should be noted that the present invention is by no means intended to be limited to these examples.

EXAMPLES

Example 1

Using a plasma CVD system, the charge injection inhibiting layer and the photoconductive layer were successively stacked on a cylindrical, electro-conductive substrate under the conditions of Table 1 and thereafter the surface layer was deposited in the thickness of 0.6 μm under the conditions of Table 2, thus producing the light receiving members 1A to 1D.

On the other hand, the toner was made as described in the following example. A reactor was charged with 6.0 mol of terephthalic acid, 3.0 mol dodecenylsuccinic anhydride, 10.0 mol of bisphenol A containing 2.0 mol of propylene oxide, 0.7 mol of trimellitic acid anhydride, and 0.1 mol of dibutyltin oxide, and a thermometer, a stirring rod, a condenser, and a nitrogen inlet pipe were attached thereto. The atmosphere inside the reactor was replaced with nitrogen and thereafter the temperature was gradually increased with stirring the mixture. The reaction was carried on at 180° C. for five hours and then the temperature was decreased to 20° C. After the pressure was reduced (to 15 hPa), the reaction was kept on for four hours to bring about dehydration and condensation. Then the reaction was terminated to obtain a polyester resin 1. This polyester resin had the peak molecular weight of 10,700 and the glass transition point of 63° C.

100 parts by weight of this polyester resin as a binding resin, 5 parts by weight of carbon black pigment, and 4 parts by weight of chromium di-t-butylsalicylate were pre-mixed in a Henschel mixer and thereafter the mixture was melted and kneaded by a double screw extruder set at 13020 C. After cooled, the kneaded product was finely crushed by a crusher using a jet air stream and the crushed particles were classified by use of a wind classifier to obtain classified particles having the weight average diameter of 6.5 μm.

Processed, inorganic, fine powder (externally attached agent) was prepared as follows. 1 kg of toluene and 200 g of particles of fine powder to be processed were charged into a vessel and stirred by a mixer to obtain a slurry. A treating agent was added thereto in a recipe amount herein and the mixture was further stirred sufficiently by the mixer. This slurry was processed for thirty minutes in a sand mill using the media of zirconia balls.

Then the slurry was taken out of the sand mill and toluene was removed therefrom with depressurizing it at 60° C. After that, it was dried at 200 to 300° C. for two hours with agitation in a stainless steel vessel. The powder obtained here was subjected to a milling process with a hammer mill, thereby obtaining the processed, inorganic, fine powder.

100 parts by weight of the aforementioned, classified particles were stirred well by the Henschel mixer and the above inorganic, fine powder was externally attached thereto and mixed, thereby obtaining the developer of the present example.

The mixing amount of the externally attached agent can be properly adjusted according to various factors such as the type of the externally attached agent, the hardness of the photosensitive member used, the image quality, and so on. In this case of the above externally attached agent, the mixing amount employed was in the proper range of 1 to 30 parts by weight.

Figure 6:
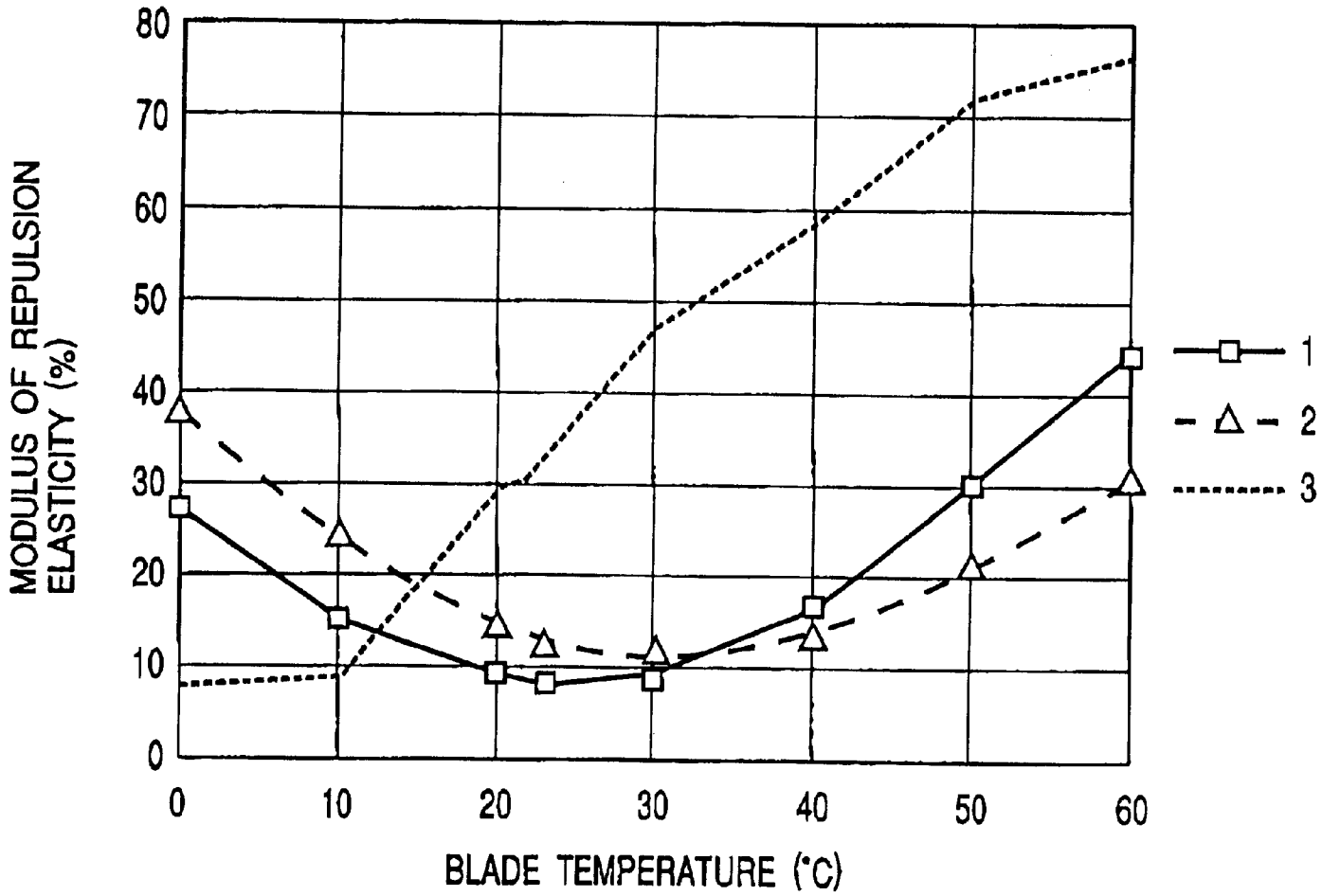
FIG. 6 is a view showing an example of temperature characteristics of blades.

Next, each of the aforementioned light receiving members 1A to 1D of the diameter of 108 mm was mounted on a testing machine (the process speed of 513 mm/sec) prepared by modifying a copying machine NP-6085 (trade name) manufactured by CANON K.K. and a continuous sheet pass endurance test was carried out by 500,000 rotations (corresponding to 470,000 A4-size sheets) to evaluate the cleaning performance. The elastic rubber blade 220 herein was a blade 1 (solid line 1 in FIG. 6) having such properties that the modulus of repulsion elasticity at a certain temperature (23° C. herein) in the temperature range of 15 to 30° C. was 8%, the modulus of repulsion elasticity at a certain temperature (41.5° C. herein) in the temperature range of 30 to 45° C. was 18%, and the JIS A hardness (Hs) was 82, and the temperature dependence of repulsion elasticity was −1%/deg to +1%/deg, as illustrated in FIG. 6. The blade 1 was set at the blade pressure of 14 gf/cm. The developer used here was one having the grain diameter of developer of 6.5 μm, as described above. Further, the original print percentage was extremely low, 1%, thereby realizing a condition in which the fusion was easy to occur. A cleaning roller made of a magnet roller was set upstream of the elastic rubber blade, whereby the developer was applied uniformly in 0.03 to 0.05 mg/cm$^2$ onto the light receiving member.

Figure 7:
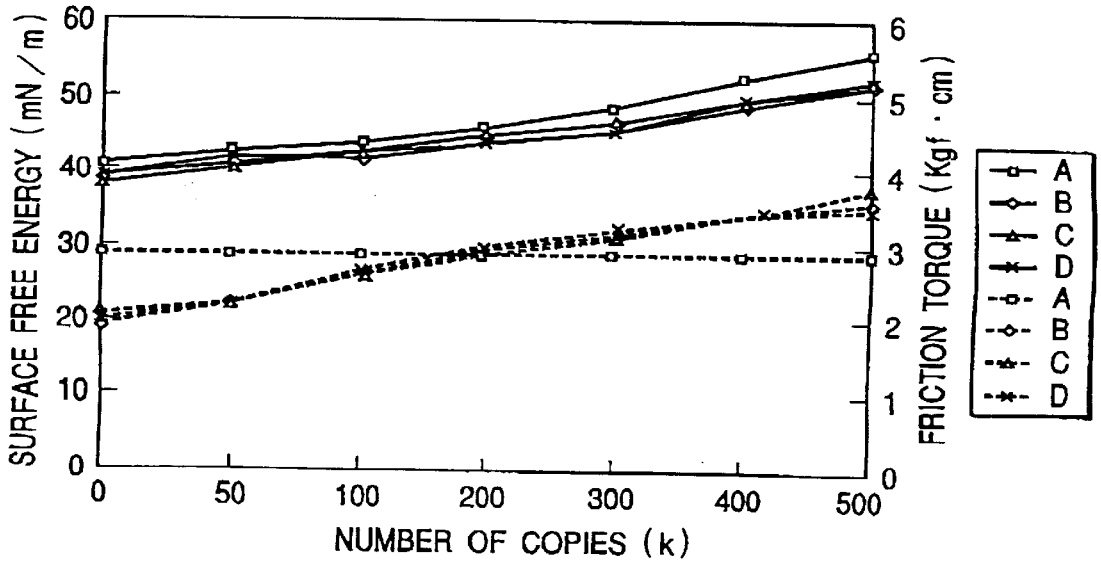
FIG. 7 is a view showing an example of changes of surface free energy with increase in the number of copies.

The results obtained in the above evaluation are shown in Tables 5 and 71. FIG. 7 is a graph illustrating the results of Table 71 in which the solid lines represent the surface free energy and the dashed lines the friction torque.

The wear losses of the surface layer after the endurance tests are shown in Table 3. The wear losses of the surface layer were obtained by measuring thicknesses of the surface layer before and after the endurance test by degrees of interference with a reflection spectroscopic interferometer (MCPD2000 (trade name) available from Otsuka Denshi K.K.) and reducing the values to wear losses per 10,000 rotations, using a known refractive index.

From the results, the light receiving members 1B, 1C were free of the image defect of the black line pattern, which could be caused by the uneven shaving, even after the endurance test of 700,000 rotations and suffered no fusion at all.

The values of the surface free energy increase with progress in the endurance test so as to become apt to permit adhesion, but, at the same time, the frictional torque also increases so as to enhance the stripping-off power. It is thus considered that the fusion is prevented by the synergistic effect with the effect of the material of the blade.

The like evaluation was conducted under the environment at 15° C. and 60% RH with power off to a heater corresponding to the surface inside heater 225 of FIG. 2, and good results similar to the above were obtained, because the temperature dependence of the blade characteristics was small.

(Uneven shaving evaluation method)

A method for evaluating the uneven shaving will be described referring to FIG. 2.

A charging current amount of the primary charger 202 was adjusted so that the dark area potential at the position of the developing unit 204 became 400 V. An original 212 with vertical lines of solid black was placed on the original platen 211 and the endurance test was conducted under such a condition that portions always scrubbed with the developer and portions not scrubbed therewith were provided in the direction of the generating line of the surface of the light receiving member. After that, the charging current amount of the primary charger 202 was adjusted so that the dark area potential at the position of the developing unit 204 became 400 V. Then a solid white original 212 was placed on the original platen 211. The on voltage of the halogen lamp 210 was adjusted so that the light area potential became 50 V, and thereafter an original 212 having the reflection density of 0.3 was placed. The potential unevenness at this time was measured to evaluate by what percentage the potential of an unevenly shaved portion has changed with respect to the potential of a normal portion.

Criteria for the evaluation were as follows.

o: good image without unevenness of sensitivity

Δ: image with potential unevenness of 2.5% or less, which is of a level posing no practical problem x: image with occurrence of potential unevenness of 2.5% or more, which could sometimes experience occurrence of density unevenness of a line pattern.

(Fusion evaluation method)

A method for evaluating the fusion will be described below, also referring to FIG. 2.

The charging current amount of the primary charger 202 was adjusted so that the dark area potential at the position of the developing unit 204 became 400 V, and the solid white original 212 was placed on the original platen 211. The on voltage of the halogen lamp 210 was adjusted so that the light area potential became 50 V, and a solid white image of the A3 size was produced. This image was used to observe black dots appearing due to the fusion of the developer and further, the surface of the light receiving member was observed with a microscope.

Criteria for the evaluation were as follows.

o: good image without fusion

Δ: image free of black dots, but fine fusion of 10 μm or less was recognized in the microscopic observation (though posing no practical problem)

x: image suffering occurrence of the black dots in certain cases.

(Torque measuring method)

The rotational torque of the light receiving member appearing with the progress in the endurance test, which was the frictional torque between the cleaner and the light receiving member, was measured with a torque gage available from Tohnichi by measuring the maximum torque at the start of rotation of the light receiving member. Changes of the torque occurring with the progress in the endurance test (or with increase in the number of copies) in Example 1 are as shown in FIG. 7.

(Surface roughness measuring method)

The surface roughness of the light receiving member was measured using SE-30D (trade name) available from Kosaka Kenkyujo K.K. The results of Example 1 are shown in Table 3.

(Surface free energy)

The surface free energy of the light receiving member, appearing with the progress in the endurance test, was obtained using a contact angle meter CSA-S ROLL (trade name) available from Kyowa Kaimen K.K., evaluation solutions of pure water, methylene iodide, and Δ-bromonaphthalene, and surface free energy analyzing software EG-11 (trade name) available from Kyowa Kaimen K.K., as analyzing software. It is noted that the evaluation solutions do not always have to be limited to the above solutions. They can be a combination of solutions having dipole components, hydrogen bond components, and the like properly dispersed. Changes of the surface free energy appearing with the progress of the endurance test (with the increase in the number of copies) in Example 1 are as shown in FIG. 7.

TABLE 1

| Fabrication conditions of light receiving member | | |
|---|---|---|
| Charge injection inhibiting layer | $SiH_4$ | 300 sccm |
| | $H_2$ | 500 sccm |
| | NO | 8 sccm |
| | $B_2H_6$ | 2000 ppm |
| | power | 100 W (13.56 MHz) |
| | internal pressure | 53.2 ? a (0.4 Torr) |
| | thickness | 1 μm |
| Photoconductive layer | $SiH_4$ | 500 sccm |
| | $H_2$ | 500 sccm |
| | power | 400 W (13.56 MHz) |
| | internal pressure | 26.6 Pa (0.5 Torr) |
| | thickness | 25 μm |

TABLE 2

| Fabrication conditions of surface layer in Example 1 | |
|---|---|
| $SiH_4/CH_4$ | (1A) 10 sccm/500 sccm<br>(1B) 10 sccm/600 sccm<br>(1C) 10 sccm/700 sccm<br>(1D) 30 sccm/300 sccm |
| Power | 150 W (13.56 MHz) |
| Temperature | 250° C. |
| Internal Pressure | 39.9 Pa (0.3 Torr) |

TABLE 3

| Light receiving member | Wear loss (Å/10,000 rotations) | Surface roughness (Rmax) |
|---|---|---|
| 1A | 0.7 | 0.25 |
| 1B | 1.2 | 0.42 |
| 1C | 4.8 | 0.42 |
| 1D | 11.5 | 0.41 |

TABLE 4

| Light receiving member | Wear loss (Å/10,000 rotations) | Surface roughness (Rmax) |
|---|---|---|
| 1A' | 0.8 | 0.25 |
| 1B' | 1.4 | 0.42 |
| 1C' | 5.0 | 0.42 |
| 1D' | 12.5 | 0.41 |
| 1A' | 0.9 | 0.24 |
| 1B' | 1.5 | 0.41 |
| 1C' | 5.0 | 0.41 |
| 1D' | 12.5 | 0.40 |

TABLE 5

| Light receiving member | Uneven shaving | | | | Fusion | | | |
|---|---|---|---|---|---|---|---|---|
| | initial | 100k | 300k | 500k | initial | 100k | 300k | 500k |
| 1A | ○ | ○ | ○ | ○ | ○ | Δ | Δ | Δ |
| 1B | ○ | ○ | ○ | ○ | ○ | ○ | ○ | ○ |
| 1C | ○ | ○ | ○ | ○ | ○ | ○ | ○ | ○ |
| 1D | ○ | Δ | Δ | Δ | ○ | ○ | ○ | ○ |
| 1A' | ○ | Δ | X | X | ○ | Δ | X | X |
| 1B' | ○ | Δ | Δ | Δ | ○ | Δ | Δ | Δ |
| 1C' | ○ | Δ | Δ | Δ | ○ | Δ | Δ | Δ |
| 1D' | ○ | Δ | X | X | ○ | Δ | X | X |
| 1A" | ○ | Δ | Δ | Δ | ○ | Δ | Δ | Δ |
| 1B" | ○ | ○ | ○ | ○ | ○ | ○ | Δ | Δ |
| 1C" | ○ | ○ | ○ | ○ | ○ | ○ | Δ | Δ |
| 1D" | ○ | Δ | Δ | Δ | ○ | Δ | Δ | Δ |

TABLE 71

| Number of copies | Surface free energy (mN/m) | | | | Friction torque (kgf.cm) | | | |
|---|---|---|---|---|---|---|---|---|
| | A | B | C | D | A | B | C | D |
| 0 | 41 | 39 | 38 | 39 | 2.9 | 1.9 | 2.1 | 2 |
| 50 | 41 | 41 | 41 | 42 | 2.9 | 2.2 | 2.3 | 2.2 |
| 100 | 44 | 42 | 43 | 43 | 2.9 | 2.7 | 2.6 | 2.7 |
| 200 | 46 | 44 | 45 | 44 | 2.9 | 3 | 2.9 | 3 |
| 300 | 49 | 46 | 47 | 46 | 2.9 | 3.2 | 3.1 | 3.2 |
| 400 | 53 | 49 | 50 | 50 | 2.9 | 3.4 | 3.4 | 3.4 |
| 500 | 56 | 52 | 52 | 53 | 2.9 | 3.8 | 3.6 | 3.5 |

Comparative Example 1

By following the procedure of Example 1 with the exception that the blade was replaced by an elastic blade 3 (dotted line 3 in FIG. 6) having such characteristics that the modulus of repulsion elasticity at a certain temperature in the temperature range of 15 to 30° C. was 31%, the modulus of repulsion elasticity at a certain temperature in the temperature range of 30 to 45° C. was 62%, and the JIS A hardness (Hs) was 74, each of the light receiving members 1A' to 1D' (respectively corresponding to those 1A to 1D) was mounted on the modified machine of the copying machine NP-6085 (trade name) manufactured by CANON K.K. and the continuous sheet pass endurance test was carried out by 500,000 rotations (corresponding to 470,000 A4-size sheets) to evaluate the cleaning performance.

Using a polishing machine as described in Japanese Patent Publication No. 7-010488 and, specifically, using a lapping film (abrasive grain: SiC, alumina, iron oxide) available from Fuji Photo Film Co., Ltd., the light receiving members 1A' to 1D' were polished to the abnormal growth heights not more than 3 μm to obtain the light receiving members 1A" to 1D". The similar evaluation to the above was carried out using these members.

The results obtained in the above evaluation of each light receiving member are shown in Table 5. The wear losses of the surface layer in the durability tests are shown in Table 4.

From the results, only the light receiving members not polished suffered the image defect of the line pattern due to the uneven shaving after the durability test of 500,000 rotations. However, the fusion etc. occurred in either case and it was not always able to mention that a good image was obtained.

Example 2

As in Example 1, using the plasma CVD system, the charge injection inhibiting layer and the photoconductive layer were stacked on the cylindrical, conductive substrate under the conditions of Table 1 and thereafter the surface layer was deposited in the thickness of 0.7 μm under the conditions of Table 6, thus producing the light receiving members 1E to 1H.

Each of the light receiving members1E to 1H was mounted on the modified machine of the copying machine NP-6085 manufactured by CANON K.K. and the continuous sheet pass endurance test was carried out by 500,000 rotations (corresponding to 470,000 A4-size sheets) to evaluate the cleaning performance. The elastic rubber blade 220 was one having such characteristics that the modulus of repulsion elasticity at a certain temperature (20° C. herein) in the temperature range of 15 to 30° C. was 8%, the modulus of repulsion elasticity at a certain temperature (43° C. herein) in the temperature range of 30 to 45° C. was 12%, and the JIS A hardness (Hs) was 81 and the developer used was one having the grain diameter of developer of 7.5 μm. Further, the original print rate was extremely low, 1%, to realize the condition in which the fusion was easy to occur. The cleaning roller made of the magnet roller was placed upstream of the elastic rubber blade, whereby the developer was applied uniformly in 0.03 to 0.05 mg/cm$^2$ onto the light receiving member.

The results obtained in the above evaluation are shown in Table 8.

From the results, the light receiving members 1F, 1H were free of the image defect of the line pattern caused by the uneven shaving even after the durability test of 500,000 rotations and also suffered no fusion at all.

The good results were also achieved when the surface roughness Rmax of the light receiving member was In the range of not less than 0.3 μm nor more than 5.0 μm.

Comparative Example 2

By following the procedure of Example 2 except for change of the surface roughness, each of the light receiving members 1E' to 1H' (respectively corresponding to the light receiving members 1E to 1H) was mounted on the modified machine of the copying machine NP-6085 (trade name) manufactured by CANON K.K. and the continuous sheet pass endurance test was carried out by 500,000 rotations (corresponding to 470,000 A4-size sheets) to evaluate the cleaning performance.

Light receiving members 1E" to 1H" (respectively corresponding to the light receiving members 1E' to 1H') were prepared in a similar fashion to those in Example 2 except that the developer was applied unevenly in the application amount range of 0.01 to 0.3 mg/cm$^2$ without provision of the cleaning roller. The similar evaluation to the above was carried out using these members.

The results obtained in the above evaluation of each light receiving member are shown in Table 8. The wear losses of the surface layer in the durability tests are shown in Table 7.

From the results, only the light receiving members tested without the cleaning roller suffered the image defect of the line pattern due to the uneven shaving after the durability test of 500,000 rotations. However, the fusion etc. occurred and a good image was not always obtained.

TABLE 6

Fabrication conditions of surface layer in Example 2

| Surface layer: $SiH_4/CH_4$ 20 sccm/300 sccm | | |
|---|---|---|
| Power | (1E) | 50 W (13.56MHz) |
| | (1F) | 100 W (13.55 MHz) |
| | (1G) | 150 W (13.56 MHz) |
| | (1H) | 250 W (13.56 MHz) |
| Temperature | | 250° C. |
| Internal pressure | | 39.9 Pa (0.3 Torr) |

TABLE 7

| Light receiving member | Wear loss (Å/10,000 rotations) | Surface roughness (Rmax) |
|---|---|---|
| 1E | 12 | 3.5 |
| 1F | 10 | 4.0 |
| 1G | 8 | 5.5 |
| 1H | 6 | 3.0 |
| 1E' | 12 | 0.45 |
| 1F' | 10 | 0.22 |
| 1G' | 8 | 0.56 |
| 1H' | 6 | 0.15 |
| 1E" | 12 | 3.5 |
| 1F" | 10 | 4.0 |
| 1G" | 8 | 5.5 |
| 1H" | 6 | 3.0 |

TABLE 8

| Light receiving member | Uneven shaving | | | | Fusion | | | |
|---|---|---|---|---|---|---|---|---|
| | initial | 100k | 300k | 500k | initial | 100k | 300k | 500k |
| 1E | ○ | Δ | Δ | Δ | ○ | ○ | ○ | ○ |
| 1F | ○ | ○ | ○ | ○ | ○ | ○ | ○ | ○ |
| 1G | ○ | Δ | Δ | X | ○ | ○ | Δ | Δ |
| 1H | ○ | ○ | ○ | ○ | ○ | ○ | ○ | ○ |
| 1E' | ○ | Δ | Δ | Δ | ○ | ○ | ○ | Δ |
| 1F' | ○ | ○ | ○ | Δ | ○ | Δ | X | X |
| 1G' | ○ | ○ | ○ | ○ | ○ | ○ | ○ | ○ |
| 1H' | ○ | ○ | ○ | ○ | ○ | Δ | X | X |
| 1E" | ○ | Δ | X | X | ○ | Δ | Δ | Δ |
| 1F" | ○ | Δ | X | X | ○ | ○ | Δ | Δ |
| 1G" | ○ | ○ | Δ | X | ○ | Δ | Δ | X |
| 1H" | ○ | Δ | Δ | Δ | ○ | ○ | Δ | Δ |

Example 3

According to a method similar to that in Example 1, using the plasma CVD system, the inhibiting layer and the photoconductive layer were stacked on the cylindrical, conductive substrate having the diameter of 108 mm and Rmax 0.45 under the conditions of Table 9 and thereafter the surface layer was deposited in the thickness of 0.6 μm thereon under the conditions of Table 10, thereby producing the light receiving members 1I to 1L. Further, surface layer samples of a-C:H were also prepared on a silicon wafer under the conditions of Table 9, as samples for measurement of the hydrogen content of the surface layer These surface layer samples were subjected to measurement of the hydrogen content H/(C+H) by IR. As a result, hydrogen contents of the surface layer samples obtained were the values shown in Table 11.

Next, each of the light receiving members 1I to 1L was mounted on the modified machine of the copying machine NP6085 (trade name) manufactured by CANON K.K and the endurance test was carried out under conditions similar to those in Example 1. The wear losses of the surface layer after the endurance tests are shown in Table 11.

Figure 8:
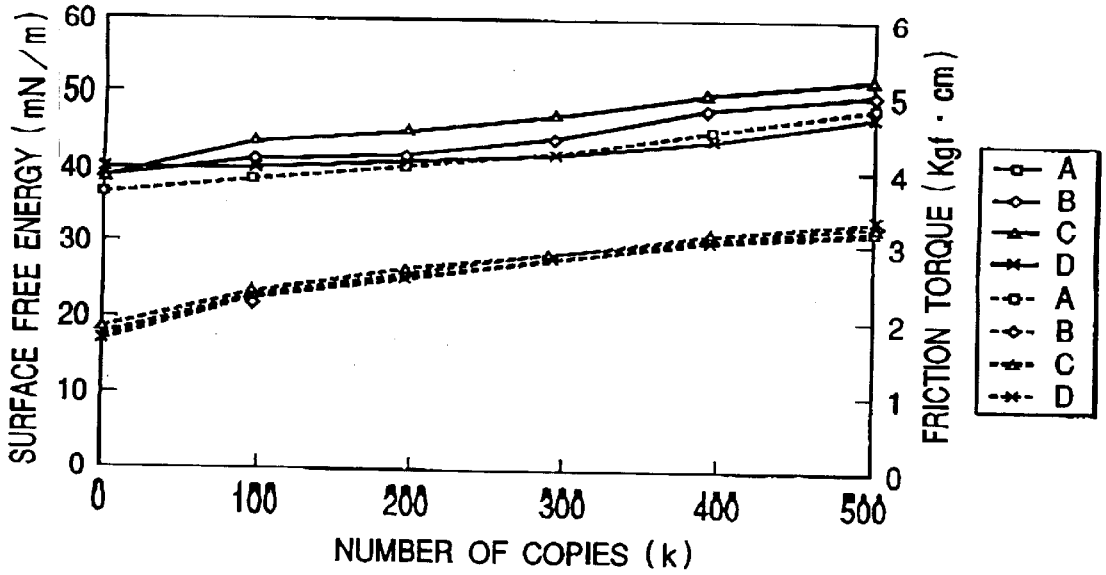
FIG. 8 is a view showing an example of changes of surface free energy with increase in the number of copies.

The results obtained in the above evaluation are shown in Tables 12 and 22. FIG. 8 is a graph illustrating the results of Table 22 in which the solid lines represent the surface free energy and the dashed lines the friction torque.

From the results, the light receiving members 1I, 1J, 1K the hydrogen content of the surface layer of which was not less than 41% nor more than 60% were free of the image defect of the line pattern caused by the uneven shaving even after the durability test of 500,000 rotations and had no problem as to the fusion, either.

TABLE 9

| Fabrication conditions of light receiving member | | |
|---|---|---|
| Lower inhibiting layer | $SiH_4$ | 300 sccm |
| | $H_2$ | 500 sccm |
| | $B_2H_6$ | 2000 ppm |
| | power | 100 W (105 MHz) |
| | internal pressure | 2.66 Pa (20 mTorr) |
| | thickness | 1 μm |
| Photoconductive layer | $SiH_4$ | 500 sccm |
| | $H_2$ | 500 sccm |
| | power | 300 W (105 MHz) |
| | internal pressure | 2.66 Pa (20 mTorr) |
| | thickness | 25 μm |

TABLE 10

| Fabrication conditions of surface layer in Example 3 | | |
|---|---|---|
| Surface layer | | |
| $CH_4/H_2$ | (1I) | 500 sccm/0 sccm |
| | (1J) | 100 sccm/200 sccm |
| | (1K) | 100 sccm/200 sccm |
| | (1L) | 100 sccm/200 sccm |
| Power | (1I) | 500 W (13/56 MHz) |
| | (1J) | 500 W (50 MHz) |
| | (1K) | 500 W (105 MHz) |
| | (1L) | 500 W (450 MHz) |
| Internal pressure | (1I) | 39.9 Pa (0.3 Torr) |
| | (1J) | 4 Pa (50 mTorr) |
| | (1K) | 4 Pa (50 mTorr) |
| | (1L) | 4 Pa (50 mTorr) |
| Temperature of substrate | (1I) | 250° C. |
| | (1J) | 250° C. |
| | (1K) | 150° C. |
| | (1L) | 50° C. |

TABLE 11

| Light receiving member | Wear loss (Å/10,000 rotations) | Hydrogen contact (%) |
|---|---|---|
| 1I | 1 | 41 |
| 1J | 6 | 55 |
| 1K | 10 | 60 |
| 1L | 18 | 55 |

Comparative Example 3

By following the procedure of Example 3 with the exception that the elastic blade was replaced by an elastic blade having such characteristics that the modulus of repulsion elasticity at a certain temperature in the temperature range of 15 to 30° C. was 31%, the modulus of repulsion elasticity at a certain temperature in the temperature range of 30 to 45° C. was 62%, and the JIS A hardness (Hs) was 74, each of the light receiving members 1I' to 1L' (respectively corresponding to the light receiving members 1I to 1L) was mounted on the modified machine of the copying machine NP-6085 (trade name) manufactured by CANON K.K. and the continuous sheet pass endurance test was carried out by 500,000 rotations (corresponding to 470,000 A4-size sheets) to evaluate the cleaning performance.

The results obtained in the above evaluation of each light receiving member are shown in Table 12. The wear losses of the surface layer in the durability tests are shown in Table 11.

It was verified from the results that the uneven shaving, fusion, and image smearing sometimes occurred in the durability test of 100,000 rotations in the case of the a-C:H films demonstrating the wear loss smaller than 1 Å/10,000 rotations and the hydrogen content over 60%.

TABLE 12

| Light receiving member | Uneven shaving | | | | Fusion | | | |
|---|---|---|---|---|---|---|---|---|
| | initial | 100k | 300k | 500k | initial | 100k | 300k | 500k |
| 1I | ○ | ○ | ○ | ○ | ○ | ○ | ○ | ○ |
| 1J | ○ | ○ | ○ | ○ | ○ | ○ | ○ | ○ |
| 1K | ○ | ○ | ○ | ○ | ○ | ○ | ○ | ○ |
| 1L | ○ | ○ | Δ | Δ | ○ | ○ | ○ | ○ |
| 1I' | ○ | Δ | X | X | ○ | ○ | Δ | Δ |
| 1J' | ○ | Δ | Δ | Δ | ○ | ○ | Δ | Δ |
| 1K' | ○ | Δ | Δ | Δ | ○ | ○ | Δ | Δ |
| 1L' | ○ | Δ | X | X | ○ | ○ | ○ | Δ |

TABLE 22

| Number of copies | Surface free energy (mN/m) | | | | Friction torque (kgf.cm) | | | |
|---|---|---|---|---|---|---|---|---|
| | A | B | C | D | A | B | C | D |
| 0 | 36 | 38 | 38 | 39 | 1.7 | 1.75 | 1.8 | 1.6 |
| 100 | 38 | 41 | 43 | 40 | 2.2 | 2.1 | 2.3 | 2.2 |
| 200 | 40 | 42 | 45 | 41 | 2.5 | 2.4 | 2.6 | 2.4 |
| 300 | 42 | 44 | 47 | 42 | 2.8 | 2.85 | 2.8 | 2.7 |
| 400 | 45 | 48 | 50 | 44 | 2.95 | 3 | 3.1 | 3 |
| 500 | 48 | 50 | 52 | 47 | 3.15 | 3.2 | 3.3 | 3.3 |

Example 4

Using the plasma CVD system, the inhibiting layer and the photoconductive layer were stacked on a cylindrical, conductive substrate obtained by machining an aluminum cylinder having the diameter 108 mm and the surface roughness Rmax in the range of 0.3 to 5.0 μm, under the conditions of Table 13 and thereafter the surface layer of SiC was deposited in the thickness of 0.6 μm under the conditions of Table 14, thereby producing the light receiving members 2A to 2D.

After that, using the polishing machine and, specifically, using the lapping film available from Fuji Photo Film Co., Ltd., the light receiving members 2A to 2D were processed before the heights of the abnormally grown portions became not more than 3 μm.

Next, each of the light receiving members 2A to 2D was mounted on a laser printer modified from a copying machine NP-6060 available from CANON K.K. (the process speed 300 mm/sec; reference is made to FIG. 3) using the developer prepared in a similar fashion to the developer used in Example 1 and the continuous sheet pass endurance test was carried out by 500,000 rotations to evaluate the cleaning performance. The elastic rubber blade 220 used was the blade 2 (dashed line 2 in FIG. 6) having such characteristics that the modulus of repulsion elasticity at a certain temperature (23° C. herein) in the temperature range of 15 to 300° C. was 12%, the modulus of repulsion elasticity at a certain temperature (4115° C. herein) in the temperature range of 30 to 45° C. was 17%, the JIS A hardness (Hs) was 81, and the temperature dependence of the repulsion elasticity was −1%/deg to +1%/deg, and the blade was set at the blade pressure of 13 gf/cm. The developer used was the one having the grain diameter of developer of 6.5 μm, as described above. Further, the original print rate was extremely low, 1%, to realize the condition in which the fusion was easy to occur. The cleaning roller made of the magnet roller was placed upstream of the elastic rubber blade, whereby the developer was applied uniformly in 0.4 to 0.6 mg/cm$^2$ onto the light receiving member.

The results obtained in the above evaluation are shown in Table 17 and FIG. 7.

The wear losses of the surface layer after the endurance tests are shown in Table 15. These wear losses of the surface layer were obtained by measuring the thicknesses of the surface layer before and after the endurance test with the reflection spectroscopic interferometer (MCPD2000 (trade name) available from Otsuka Denshi K.K.) and reducing them to wear losses per 10,000 rotations.

From the results, the light receiving members 2B, 2C were free of the image defect of the black line pattern caused by the uneven shaving even after the endurance test of 500,000 rotations and suffered no fusion at all.

The values of the surface free energy increase with the progress of the endurance test (with increase in the number of copies) so as to facilitate the adhesion, but the frictional torque also increases at the same time. It is thus considered that the fusiorn is prevented by the synergistic effect with the effect of the material of the blade.

The evaluation was also carried out similarly under the environment at 15° C. and 60% RH and with power off to the heater corresponding to the surface inside heater 225 of FIG. 2, and good results similar to above were obtained, because the temperature dependence of the blade characteristics was small.

TABLE 13

| Fabrication conditions of light receiving member | | |
|---|---|---|
| Charge injection inhibiting layer | $SiH_4$ | 300 sccm |
| | $H_2$ | 500 sccm |
| | NO | 8 sccm |
| | $B_2H_6$ | 2000 ppm |
| | power | 100 W (13.56 MHz) |
| | internal pressure | 53.2 Pa (0.4 Torr) |
| | thickness | 3 μm |
| Photoconductive layer | $SiH_4$ | 500 sccm |
| | $H_2$ | 500 sccm |
| | power | 400 W (13.56 MHz) |
| | internal pressure | 26.6 Pa (0.5 Torr) |
| | thickness | 40 μm |

TABLE 14

| Fabrication conditions of surface layer in Example 4 | |
|---|---|
| $SiH_4/CH_4$ | (2A) 10 sccm/500 sccm |
| | (2B) 10 sccm/600 sccm |
| | (2C) 10 sccm/700 sccm |
| | (2D) 30 sccm/300 sccm |
| Power | 150 W (13.56 MHz) |
| Temperature | 250° C. |
| Internal Pressure | 39.9 Pa (0.3 Torr) |

TABLE 15

| Light receiving member | Wear loss (Å/10,000 rotations) |
|---|---|
| 2A | 0.7 |
| 2B | 1.2 |
| 2C | 4.8 |
| 2D | 11.5 |

From the results, the light receiving members 2B, 2° C. were free of the image defect of the black line pattern caused by the uneven shaving even after the endurance test of 500,000 rotations and suffered no fusion at all.

Values of the surface free energy increase with the progress of the endurance test so as to facilitate the adhesion, but the frictional torque also increases at the same time. It is thus considered that the fusion is prevented by the synergistic effect with the effect of the material of the blade.

The evaluation was also carried out similarly unaer the environment at 15° C. and 60% RH and with power off to the heater corresponding to the surface inside heater 225 of FIG. 2, and good results similar to above were obtained, because the temperature dependence of the blade characteristics was small.

Comparative Example 4

By following the procedure of Example 4 with the exception that the blade was replaced by an elastic blade having such characteristics that the modulus of repulsion elasticity at a certain point in the temperature range of 15 to 30° C. was 30%, the modulus of repulsion elasticity at a certain point in the temperature range of 30 to 45° C. was 61%, and the JIS A hardness (Hs) was 75, each of the light receiving members 2A' to 2D' (respectively corresponding to the light receiving members 2A to 2D) was mounted on the modified machine of the copying machine NP-6350 (trade name) manufactured by CANON K.K. and the continuous sheet pass endurance test was carried out by 500,000 rotations to evaluate the cleaning performance.

The light receiving members 2A" to 2D" were also prepared without execution of the process using the polishing machine. The evaluation similar to that in Example 4 was conducted using these members.

The results obtained in the above evaluation of each light receiving member are shown in Table 17. The wear losses of the surface layer in the endurance tests are shown in Table 16.

From the results, the difference of the effect was definite between the blades and the members prepared without polishing suffered the image defect of the line pattern due to the uneven shaving, and the fusion after the durability test of 500,000 rotations, so as not toprovide a good image necessarily.

TABLE 16

| Light receiving member | Wear loss (Å/10,000 rotations) |
|---|---|
| 2A' | 0.8 |
| 2B' | 1.4 |
| 2C' | 5.0 |
| 2D' | 12.5 |
| 2A" | 0.9 |
| 2B" | 1.5 |
| 2C" | 5.0 |
| 2D" | 12.5 |

TABLE 17

| Light | Uneven shaving | | | | Fusion | | | |
|---|---|---|---|---|---|---|---|---|
| re-ceiving member | ini-tial | 100k | 300k | 500k (rota-tions) | ini-tial | 100k | 300k | 500k (rota-tions) |
| 2A | ○ | ○ | ○ | ○ | ○ | Δ | Δ | Δ |
| 2B | ○ | ○ | ○ | ○ | ○ | ○ | ○ | ○ |
| 2C | ○ | ○ | ○ | ○ | ○ | ○ | ○ | ○ |
| 2D | ○ | Δ | Δ | Δ | ○ | ○ | ○ | ○ |
| 2A' | ○ | Δ | X | X | ○ | Δ | X | X |
| 2B' | ○ | Δ | Δ | Δ | ○ | Δ | Δ | Δ |
| 2C' | ○ | Δ | Δ | Δ | ○ | Δ | Δ | Δ |
| 2D' | ○ | Δ | X | X | ○ | Δ | X | X |
| 2A" | ○ | Δ | Δ | Δ | ○ | Δ | Δ | Δ |
| 2B" | ○ | ○ | ○ | ○ | ○ | ○ | Δ | Δ |
| 2C" | ○ | ○ | ○ | ○ | ○ | ○ | Δ | Δ |
| 2D" | ○ | Δ | Δ | Δ | ○ | Δ | Δ | Δ |

Example 5

As in Example 4, using the plasma CVD system, the inhibiting layer and the photoconductive layer were stacked on the cylindrical, conductive substrate under the conditions of Table 13 and thereafter the surface layer was deposited in the thickness of 0.7 μm under the conditions of Table 18, thereby producing the light receiving members of 2E to 2H.

TABLE 18

| Fabrication conditions of surface layer in Example 5 | | |
|---|---|---|
| Surface layer | $SiH_4/CH_4$ 20 sccm/300 sccm | |
| | Power | (2E) 50 W (13.56 MHz)<br>(2F) 100 W (13.56 MHz)<br>(2G) 150 W (13.56 MHz)<br>(2H) 250 W (13.56 MHz) |
| | Temperature | 250° C. |
| | Internal pressure | 39.9 Pa (0.3 Torr) |

Next, each of the light receiving members 2E to 2H was mounted on the modified machine (the process speed 500 mm/sec) of the copying machine NP-6060 (trade name) manufactured by CANON K.K. and the continuous sheet pass endurance test was carried out by 500,000 rotations to evaluate the cleaning performance (FIG. 2). The elastic rubber blade 220 used herein wag one having such characteristics that the modulus of repulsion elasticity at a certain temperature in the temperature range of 15 to 30° C. was 8%, the modulus of repulsion elasticity at a certain temperature in the temperature range of 30 to 45° C. was 12%, and the JIS A hardness (Hs) was 81, and the developer used was the one having the grain diameter of developer of 7.5 μm. Further, the original print rate was extremely low, 1%, to realize the condition in which the fusion was easy to occur. The cleaning roller made of the magnet roller was placed upstream of the elastic rubber blade and the developer was applied uniformly in 0.4 to 0.6 mg/cm$^2$ onto the light receiving member.

The results obtained in the above evaluation are shown in Table 20.

From the results, the light receiving members 2F, 2H were free of the image defect of the line pattern caused by the uneven shaving even after the endurance test of 500,000 rotations and suffered no fusion at all.

The good results were also achieved when the surface roughness Rmax of the light receiving member was in the range of not less than 0.3 μm nor more than 5.0 μm.

Comparative Example 5

By following the procedure of Example 5 except for change of the surface roughness, each of the light receiving members 2E' to 2H' was mounted on the laser printer modified machine of the copying machine NP-6060 (trade name) manufactured by CANON K.K. and the continuous sheet pass endurance test was carried out by 500,000 rotations to evaluate the cleaning performance.

The light receiving members 2E" to 2F" were also prepared in a similar fashion to those in Example 5 except that the developer was applied unevenly in the application amount range of 0.01 to 0.6 mg/cm$^2$ without provision of the cleaning roller. The evaluation similar to above was conducted using these members.

The results obtained in the above evaluation of each light receiving member are shown in Table 20. The wear losses of the surface layer in the endurance tests are shown in Table 19.

TABLE 19

| Light receiving member | Wear loss (Å/10,000 rotations) | Surface roughness (RmaΣ) |
|---|---|---|
| 2E | 12 | 3.5 |
| 2F | 10 | 4.0 |
| 2G | 8 | 5.5 |
| 2H | 6 | 3.0 |
| 2E' | 12 | 0.45 |
| 2F' | 10 | 0.22 |
| 2G' | 6 | 0.56 |
| 2H' | 6 | 0.15 |
| 2E" | 12 | 3.5 |
| 2F" | 10 | 4.0 |
| 2G" | 8 | 5.5 |
| 2H" | 6 | 3.0 |

TABLE 20

| Light receiving member | Uneven shaving initial | 100k | 300k | 500k (rotations) | Fusion initial | 100k | 300k | 500k (rotations) |
|---|---|---|---|---|---|---|---|---|
| 2E | ○ | Δ | Δ | Δ | ○ | ○ | ○ | ○ |
| 2F | ○ | ○ | ○ | ○ | ○ | ○ | ○ | ○ |
| 2G | ○ | Δ | Δ | X | ○ | ○ | Δ | Δ |
| 2H | ○ | ○ | ○ | ○ | ○ | ○ | ○ | ○ |
| 2E' | ○ | Δ | Δ | Δ | ○ | ○ | ○ | Δ |
| 2F' | ○ | ○ | ○ | Δ | ○ | Δ | X | X |
| 2G' | ○ | ○ | ○ | ○ | ○ | ○ | ○ | ○ |
| 2H' | ○ | ○ | ○ | ○ | ○ | Δ | X | X |
| 2E" | ○ | Δ | X | X | ○ | Δ | Δ | Δ |
| 2F" | ○ | Δ | X | X | ○ | ○ | Δ | Δ |
| 2G" | ○ | ○ | Δ | X | ○ | Δ | Δ | X |
| 2H" | ○ | Δ | Δ | X | ○ | ○ | Δ | Δ |

Example 6

Each of the light receiving members 1I to 1L prepared in Example 3 was mounted on the laser printer modified machine (the process speed 300 mm/sec) of the copying machine NP-6060 (trade name) manufactured by CANON K.K. and the endurance test was carried out under the conditions similar to those in Example1.

The results obtained in the above evaluation are shown in Table 21.

From the results, when either of the light receiving members 1I, 1J, and 1K the hydrogen content of the a-C:H surface layer of which was not less than 41% nor more than 60% was used in the laser beam printer, they were free of the image defect of the line pattern caused by the uneven shaving even after the endurance test of 500,000 rotations and had no problem as to the fusion, either.

TABLE 21

| Light receiving member | Uneven shaving initial | 100k | 300k | 500k (rotations) | Fusion initial | 100k | 300k | 500k (rotations) |
|---|---|---|---|---|---|---|---|---|
| I | ○ | ○ | ○ | ○ | ○ | ○ | ○ | ○ |
| J | ○ | ○ | ○ | ○ | ○ | ○ | ○ | ○ |
| K | ○ | ○ | ○ | ○ | ○ | ○ | ○ | ○ |
| L | ○ | ○ | Δ | Δ | ○ | ○ | ○ | ○ |
| I' | ○ | Δ | X | X | ○ | ○ | Δ | Δ |
| J' | ○ | Δ | Δ | Δ | ○ | ○ | Δ | Δ |
| K' | ○ | Δ | Δ | Δ | ○ | ○ | Δ | Δ |
| L' | ○ | Δ | X | X | ○ | ○ | ○ | Δ |

Comparative Example 6

Each of the light receiving members 1I' to 1L' was mounted on the laser printer modified machine of the copying machine NP-6060 (trade name) manufactured by CANON K.K. and the continuous sheet pass endurance test was carried out by 500,000 rotations to evaluate the cleaning performance.

The results obtained in the above evaluation of each light receiving member are shown in Table 21. The wear losses of the surface layer in the endurance tests were also similar in the case of the laser beam printer to those in Example 3.

From the results, it was also verified in the operation in the laser printer that the uneven shaving, fusion, and image smearing could sometimes occur after the endurance test of 500,000 rotations in the case of the a-C:H films having the wear amount smaller than 1 Å/10,000 rotations and the hydrogen content over 60%.

It should be noted that the present invention embraces all appropriate modifications and combinations within the scope of the spirit of the present invention and it is needless to mention that the present invention is by no means limited to the above examples.

As detailed above, according to the present invention, it becomes possible to form stable images over a long period without the fusion of developer and without the uneven shaving. Further, the present invention can lengthen the maintenance periods and in turn reduce the running cost.

Further, the present invention can prevent the image density irregularities caused by the uneven shaving and the fusion of developer in the electrophotographic apparatus arranged to rotate the light receiving member at 400 to 600 mm/sec and successively repeat the charging, exposure development, and cleaning, particularly, in the structure in which the light receiving member having the surface layer of the non-monocrystalline SiC film containing hydrogen is subjected to the development and transfer to the transfer medium and the surface of the light receiving member after the transfer of developer is scrape-cleaned with the elastic rubber blade, wherein the wear loss after the A4-size copying steps on the transfer sheets is in the range of not less than 1 Å/10,000 rotations nor more than 10 Å/10,000 rotations.

In addition, the image defects such as the image smearing and image unfocussing can be prevented effectively in the electrophotographic apparatus arranged to rotate the light receiving member at 400 to 600 mm/sec and successively repeat the charging, exposure, development, transfer, and cleaning, particularly, in the electrophotographic apparatus arranged so that the light receiving member having the surface layer of the non-monocrystalline hydrogenated carbon film containing hydrogen 41t to 60% (a-C:H) is subjected to the development and transfer to the transfer medium and the surface of the light receiving member after the transfer of developer is scrape-cleaned with the elastic rubber blade, wherein the wear loss after the A-4 size copying steps on the transfer sheets is in the range of not less than 1 Å/10,000 rotations nor more than 10 Å/10,000 rotations.

In addition, the present invention can prevent the image density irregularities caused by the uneven shaving and the fusion of developer in the electrophotographic apparatus arranged to rotate the light receiving member at 300 to 500 mm/sec and successively repeat the charging, exposure, development, transfer, and cleaning, particularly, in the electrophotographic apparatus arranged in the structure in which the light receiving member having the surface layer of the non-monocrystalline SiC film containing hydrogen is subjected to the development and transfer and the surface of the light receiving member after the transfer is scrape-cleaned with the elastic rubber blade after the developer is applied in 0.4 to 0.6 mg/cm$^2$ onto the light receiving member with the roller provided upstream of the elastic rubber blade, wherein the wear loss after the A-4 size copying steps on the transfer sheets is in the range of not less than 1 Å/10,000 rotations nor more than 10 Å/10,000 rotations.

In addition, the image defects such as the image smearing and the image unfocussing can be prevented effectively in the electrophotographic apparatus arranged to rotate the light receiving member at 300 to 500 mm/sec and successively repeat the charging, exposure, development, transfer, And cleaning, particularly, in the electrophotographic apparatus arranged in the structure in which the light receiving member having the surface layer of the non-monocrystalline hydrogenated carbon film containing hydrogen 41% to 60% (a-C:H) is subjected to the development and transfer and the surface of the light receiving member after the transfer is scrape-cleaned with the elastic rubber blade after the developer is applied in 0.4 to 0.6 mg/cm$^2$ onto the light receiving member with the roller provided upstream of the elastic rubber blade, wherein the wear loss after the A-4 size copying steps on the transfer sheets is in the range of not less than 1 Å/10,000 rotations nor more than 10 Å/10,000 rotations.

Further, the elastic rubber blade can drastically expand the latitude for preventing the image defects such as the image smearing and the image unfocussing by the structure of the elastic blade having such characteristics that the modulus of repulsion elasticity at a temperature in the temperature range (zone A) of 15 to 30° C. is 5 to 15%, the modulus of repulsion elasticity at a temperature in the temperature range (zone B) of 30 to 45° C. is 10 to 20%, and the JIS A hardness (Hs) is not less than 77 nor more than 85.

What is claimed is:

1. A cleaning device of an electrophotographic apparatus, the electrophotographic apparatus being arranged to rotate a light receiving member at 400 to 600 mm/sec and successively repeat charging, exposure, development, transfer, and cleaning, the light receiving member being subjected to development and transfer of a developer onto a transfer medium and thereafter a surface of the light receiving member being scrape-cleaned with an elastic rubber blade, wherein the wear loss of the light receiving member after copying steps on transfer sheets is within a range of not less than 1 Å/10,000 rotations nor more than 10 Å/10,000 rotations.

2. The cleaning device according to claim 1, which is applied to the light receiving member a surface layer of which is comprised of a non-monocrystalline SiC film containing hydrogen.

3. The cleaning device according to claim 1, which is applied to the light receiving member a surface layer of which is comprised of a non-monocrystalline hydrogenated carbon film.

4. The cleaning device according to claim 3, wherein the hydrogen content of the non-monocrystalline hydrogenated carbon film is 41% to 60%.

5. The cleaning device according to claim 1, wherein the elastic rubber blade is an elastic rubber blade having such characteristics that the modulus of repulsion elasticity at a temperature within a range of 15 to 30° C. is a value within a range of 5 to 15%, the modulus of repulsion elasticity at a temperature within a range of 30 to 45° C. is a value within a range of 10 to 20%, and hardness (Hs) is not less than 77 nor more than 85.

6. The cleaning device according to claim 1, wherein the elastic rubber blade has a temperature dependence of the modulus of repulsion elasticity in a temperature range of 10 to 50C., within a range of −1%/deg to +1%/deg.

7. The cleaning device according to claim 1, further comprising a roller upstream of the elastic rubber blade.

8. The cleaning device according to claim 7, wherein the roller is provided for applying the developer in an amount of 0.03 to 0.3 mg/cm$^2$ onto the light receiving member.

9. The cleaning device according to claim 1, wherein the surface roughness of the light receiving member, Rmax, is not less than 0.3 $\mu$m nor more than 5.0 $\mu$m.

10. The cleaning device according to claim 9, wherein the light receiving member is processed by polishing the surface thereof so as to reduce heights of abnormally grown projections to not more than 5.0 $\mu$m.

11. The cleaning device according to claim 1, wherein the weight average grain diameter of the developer is 5 to 8 $\mu$m.

12. An electrophotographic process comprising the cleaning device of claim 1.

13. The cleaning device according to claim 1, wherein the light receiving member is constructed so as to decrease surface roughness, increase surface free energy, and increase frictional torque against the blade according to progress of the wearing of the light receiving member.

14. A cleaning device of an electrophotographic apparatus, the electrophbtographic apparatus being arranged to rotate a light receiving member at 300 to 500 mm/sec and successively repeat charging, exposure, development, transfer, and cleaning, the electrophotographic apparatus being arranged to subject the light receiving member to development and transfer of a developer and scrape-clean a surface of the light receiving member with an elastic rubber blade after the developer is applied in an amount of 0.4 to 0.6 mg/cm$^2$ onto the light receiving member with a roller provided upstream of the elastic rubber blade, wherein the wear loss of the light receiving number after A4-size copying steps on transfer sheets is within a range of not less than 1 Å/10,000 rotations nor more than 10 Å/10,000 rotations.

15. The cleaning device according to claim 14, wherein the light receiving member has a surface layer comprised of a non-monocrystalline SiC film containing hydrogen.

16. The cleaning device according to claim 14, wherein the light receiving member has a surface layer comprised of a non-monocrystalline hydrogenated carbon film.

17. The cleaning device according to claim 16, wherein the hydrogen content of the non-monocrystalline hydrogenated carbon film is 41% to 60%.

18. The cleaning device according to claim 14, wherein the elastic rubber blade is an elastic rubber blade having such characteristics that the modulus of repulsion elasticity at a temperature within a range of 15 to 30° C. is a value within a range of 5 to 15%, the modulus of repulsion elasticity at a temperature within a range of 30 to 45° C. is a value within a range of 10 to 20%, and hardness (Hs) is not less than 77 nor more than 85.

19. The cleaning device according to claim 14, wherein the elastic rubber blade has a temperature dependence of the modulus of repulsion elasticity in a temperature range of 15 to 45° C., within a range of −1 %/deg to +1%/deg.

20. The cleaning device according to claim 14, wherein the light receiving member is used after a polishing process to polish the surface thereof so as to reduce heights of abnormally grown projections to not more than 5.0 $\mu$m.

21. The cleaning device according to claim 14, wherein the weight average grain size of the developer is 5 to 8 $\mu$m.

22. An electrophotographic apparatus comprising the cleaning device of claim 14.

23. The cleaning device according to claim 14, wherein the light receiving member is constructed so as to decrease surface roughness, increase surface free energy, and increase frictional torque against the blade according to progress of the wearing of the light receiving member.

24. A cleaning method of an electrophotographic apparatus, which comprises scrape-cleaning a surface of a light receiving member with an elastic rubber blade while moving the light receiving member and the elastic rubber blade relative to each other at a relative speed of 400 to 600 mm/sec, wherein the wear loss of the light receiving member is within a range of not less than 1 Å/10,000 rotations nor more than 10 Å/10,000 rotations.

25. The cleaning method according to claim 24, wherein the light receiving member has a surface layer comprised of a non-monocrystalline SiC film containing hydrogen.

26. The cleaning method according to claim 24, wherein the light receiving member has a surface layer comprised of a non-monocrystalline hydrogenated carbon film.

27. The cleaning method according to claim 24, wherein the elastic rubber blade is an elastic rubber blade having such characteristics that the modulus of repulsion elasticity at a temperature within a range of 15 to 30 ° C. is a value within a range of 5 to 15%, the modulus of repulsion elasticity at a temperature within a range of 30 to 45° C. is a value within a range of 10 to 20%, and hardness (Hs) is not less than 77 nor more than 85.

28. The cleaning method according to claim 24, wherein the elastic rubber blade has a temperature dependence of the modulus of repulsion elasticity in a temperature range of 10 to 50° C., within a range of −1%/deg to +1%/deg.

29. The cleaning method according to claim 24, further comprising a step of applying the developer in an amount of 0.03 to 0.3 mg/cm$^2$ onto the light receiving member before the scrape-cleaning.

30. The cleaning method according to claim 24, wherein the surface roughness of the light receiving member, Rmax, is not less than 0.3 $\mu$m nor more than 5.0$\mu$m.

31. The cleaning method according to claim 30, wherein the light receiving member is processed by polishing the surface thereof so as to reduce heights of abnormally grown projections to not more than 5.0 $\mu$m.

32. The cleaning method according to claim 24, wherein the hydrogen content of the non-monocrystalline hydrogenated carbon film is 41% to 60%.

33. The cleaning method according to claim 24, wherein the scrape-cleaning is carried out for removing a developer having a weight average grain diameter of 5 to 8 $\mu$m.

34. An electrophotographic process comprising the cleaning method of claim 24.

35. A cleaning method of an electrophotographic apparatus, which comprises scrape-cleaning a surface of a light receiving member with an elastic rubber blade while moving the light receiving member and the elactic rubber blade relative to each other at a relative speed of 300 to 500 m/sec, there in the wear loss of the light receiving member after application of developer in 0.4 to 0.6 mg/cm$^2$ and execution of the scrape-cleaning is within a range of not less than 1 Å/10,000 rotations nor more than 10 Å/10,000 rotations.

36. The cleaning method according to claim 35, wherein the light receiving member has a surface layer comprised of a nons monoctrstaline SiC film containing hydrogen.

37. The cleaning method according to claim 35, wherein the light receiving member has a surface layer comprised of a non-monocrystallne hydrogenated carbon film.

38. The cleaning method according to claim 35, wherein the elastic rubber blade is an elastic rubber blade having such characteristics that the modulus of repulsion elasticity at a temperature within a range of 15 to 30° C. is a value within a range of 5 to 15%, the modulus of repulsion elasticity at a temperature within a range of 3a to 45° C. is a value within a range of 10 to 20%, and hardness (Hs) is not less than 77 nor more than 85.

39. The cleaning method according to claim 30, wherein the elastic rubber blade has a temperature dependence of the modulus of repulsion elasticity in a temperature range of 15 to 45° C., within a range of −1%/deg to +1%/deg.

40. The cleaning method according to claim 35, wherein the light receiving member is processed by polishing the surface thereof so as to reduce heights of abnormally grown projections to not more than 5.0 $\mu$m.

41. The cleaning method according to claim 35, wherein the hydrogen content of the non-monocrystalline hydrogenated carbon film is 41% to 60%.

42. The cleaning method according to claim 35, wherein the weight average grain diameter of the developer is 5 to 8 $\mu$m.

43. An electrophotographic process comprising the cleaning method of claim 35.

* * * * *

UNITED STATES PATENT AND TRADEMARK OFFICE

CERTIFICATE OF CORRECTION

PATENT NO. : 6,055,404
DATED : April 25, 2000
INVENTOR(S) : Koji Yamazaki et al.

It is certified that error appears in the above-identified patent and that said Letters Patent is hereby corrected as shown below:

Column 1,
Line 15, "the," should read -- the --.

Column 2,
Line 22, "matrices-called" should read -- matrices called --.
Line 37, "a-SI" should read -- A-Si --.

Column 3,
Line 42, Increas-" should read -- increas- --.

Column 4,
Line 5, "Increase" should read -- increase --.
Line 10, "is" should be deleted.

Column 5,
Line 5, "fight" should read -- light --.

Column 7,
Line 8, "the," should read -- the --.
Line 42, "15," should read -- 15% --.
Line 52, "cleaning," should read -- cleaning; --.

Column 8,
Line 6, "round-bar" should read -- round bar --.

Column 9,
Line 29, "cf" should read -- of --.

Column 10,
Line 41, "2is" should read -- 2 is --.

Column 11,
Line 49, "Itself" should read -- itself --.

Column 12,
Line 65, "13020 C." should read -- 130°C. --.

UNITED STATES PATENT AND TRADEMARK OFFICE

CERTIFICATE OF CORRECTION

PATENT NO. : 6,055,404
DATED : April 25, 2000
INVENTOR(S) : Koji Yamazaki et al.

It is certified that error appears in the above-identified patent and that said Letters Patent is hereby corrected as shown below:

Column 15,
TABLE 1, "53.2 ? a" should read -- 53.2 Pa --.

Column 16,
TABLE 4, "1A' -- 1A'
1B' 1B'
1C' should 1C'
1D' read 1D'
1A' 1A"
1B' 1B"
1C' 1C"
1D' 1D" --.

Column 17,
Line 23, "membersIE" should read -- members 1E --.
Line 49, "In" should read -- in --.

Column 18,
TABLE 6, "100 W (13.55 MHz)" should read -- 100 W (13.56 MHz) --.

Column 19,
TABLE 10, "500 W (13/56 MHz) " should read -- 500 W (13.56 MHz) --.

Column 20,
TABLE11, "1L 18 55" should read
-- 1L 18 65 --.

Column 21,
Line 25, "300°" should read -- 30° --.
Line 27, " (4115°C. " should read -- 41.5°C. -- .
Line 59, "fusiorn" should read -- fusion --.

UNITED STATES PATENT AND TRADEMARK OFFICE

CERTIFICATE OF CORRECTION

PATENT NO. : 6,055,404
DATED : April 25, 2000
INVENTOR(S) : Koji Yamazaki et al.

It is certified that error appears in the above-identified patent and that said Letters Patent is hereby corrected as shown below:

Column 22,
Line 39, "2°C." should read -- 2C --.
Line 49, "unaer" should read -- under --.

Column 23,
Line 13, "toprovide" should read -- to provide --.

Column 24,
Line 7, "wag" should read – was --.
TABLE 19, "2G' 6 0.56" should read
-- 2G' 8 0.56 --.

Column 25,
TABLE 20, "500k (rotations) -- 500k (rotations)

| | | |
|---|---|---|
| Δ | | Δ |
| o | | o |
| x | | x |
| o | | o |
| Δ | | Δ |
| Δ | should | Δ |
| o | read | o |
| o | | o |
| x | | x |
| x | | x |
| x | | x |
| x" | | Δ --. |

Column 26,
Line 36, "41t" should read -- 41% --.
Line 67, "And" should read -- and --.

Column 27,
Line 57, "50C.," should read -- 50°C., --.

Column 28,
Line 13, "electrophbtographic" should read -- electrophotographic --.
Line 5, "process" should read -- apparatus --.

UNITED STATES PATENT AND TRADEMARK OFFICE

CERTIFICATE OF CORRECTION

PATENT NO. : 6,055,404
DATED : April 25, 2000
INVENTOR(S) : Koji Yamazaki et al.

It is certified that error appears in the above-identified patent and that said Letters Patent is hereby corrected as shown below:

Column 30,
Line 3, "there in" should read -- wherein --.
Line 10, "nons monoctrstaline" should read -- non-monocrystalline --.
Line 13, "3a" should read -- 30 --.
Line 22, "claim 30," should read -- claim 35, --.

Signed and Sealed this

Twenty-fifth Day of December, 2001

*Attest:*

*Attesting Officer*

JAMES E. ROGAN
*Director of the United States Patent and Trademark Office*